US006009852A

United States Patent [19]

Akabori et al.

[11] Patent Number: 6,009,852

[45] Date of Patent: Jan. 4, 2000

[54] ENGINE IDLE ROTATION SPEED CONTROLLER

[75] Inventors: Kouichi Akabori, Yokosuka; Nobutaka Takahashi, Yokohama; Yoshitaka Deguchi, Yokosuka, all of Japan

[73] Assignee: Nissan Motor Co., Ltd., Kanagawa, Japan

[21] Appl. No.: 08/869,882

[22] Filed: Jun. 5, 1997

[30] Foreign Application Priority Data

Jun. 5, 1996 [JP] Japan ..... 8-143031

[51] Int. Cl.[7] ..... F02D 41/08

[52] U.S. Cl. ..... 123/339.19; 123/339.21

[58] Field of Search ..... 123/339.18, 339.19, 123/339.21, 339.16, 339.17, 339.22, 324, 329; 477/109, 111

[56] References Cited

U.S. PATENT DOCUMENTS

| | | | |
|---|---|---|---|
| 4,355,550 | 10/1982 | Will et al. | 74/858 |
| 4,760,823 | 8/1988 | Yasuoka et al. | 123/339.16 |
| 4,841,447 | 6/1989 | Hayashi et al. | 123/493 |
| 4,993,283 | 2/1991 | Kikuchi et al. | 74/858 |
| 5,012,779 | 5/1991 | Fukui et al. | 123/339.19 |
| 5,081,597 | 1/1992 | Maebashi | 123/339.19 |
| 5,291,802 | 3/1994 | Kuriyama | 74/858 |
| 5,415,143 | 5/1995 | Togai | 123/339.19 |
| 5,577,979 | 11/1996 | Iizuka | 477/109 |
| 5,630,394 | 5/1997 | Grizzle et al. | 123/339.19 |

FOREIGN PATENT DOCUMENTS

| | | |
|---|---|---|
| 57-83665 | 5/1982 | Japan . |
| 2-70955 | 3/1990 | Japan . |
| 7-259616 | 10/1995 | Japan . |

*Primary Examiner*—Erick R. Solis
*Attorney, Agent, or Firm*—McDermott, Will & Emery

[57] ABSTRACT

Engine rotation speed during idle running is feedback-controlled. A second target rotation speed which progressively decreases towards a first target rotation speed from a predetermined engine rotation speed, is set. The engine rotation speed is feedback-controlled based on a difference between a present rotation speed and this second target rotation speed. In this way, compared to the case where feedback control is performed using the first target rotation speed as a target value, the time period during which the engine rotation speed falls below the first target rotation speed is shortened and the engine rotation speed is made to stably converge to the first target rotation speed.

24 Claims, 23 Drawing Sheets

ENGINE IDLE ROTATION SPEED CONTROLLER

FIELD OF THE INVENTION

This invention relates to control of idle engine rotation speed.

BACKGROUND OF THE INVENTION

In a vehicle engine which is running idle, when load increases, the engine rotation speed falls considerably. To prevent this drop of engine rotation speed, a controller is known in the art which performs feedback control such that the idle rotation speed coincides with a target idle engine rotation speed via intake air volume control.

However, in this feedback control of idle engine rotation speed via intake air volume control, there is a response delay from when intake air volume is increased to engine torque increase, and due to this delay, it may occur that the drop in rotation speed when there is a sudden load change cannot be corrected in time.

To resolve this problem, Tokkai Sho 57-83665 published by the Japanese Patent Office in 1982 discloses how idle engine speed is controlled to a target idle engine speed in a short time by applying ignition timing control which has a small response delay, in conjunction with intake air volume control.

However even in this control system, when feedback control of idle engine rotation speed is started, the feedback correction amount of intake air volume and ignition timing becomes large if the engine rotation speed largely exceeds a target rotation speed NSET. In particular, when integral control is applied to feedback control, the integral part of the feedback correction amount of the intake air volume largely increases in a negative direction as shown in FIG. 21B so the intake air volume temporarily suffers a serious decrease. As a result, the engine rotation speed drops below the target idle engine rotation speed as shown in FIG. 21A.

This drop in rotation speed is particularly marked after the load suddenly decreases due to shift down of an automatic transmission, the engine rotation speed suddenly increases temporarily, and the difference between the engine rotation speed and target idle engine rotation speed becomes large, as shown in FIGS. 22A and 22B.

Tokkai Hei 2-70955 published by the Japanese Patent Office published in 1990 suggests that to deal with this phenomenon, when a shift-down of the automatic transmission occurs during feedback control of the idle rotation speed, feedback control is stopped for a predetermined time.

Further, to suppress hunting of the engine rotation speed, the engine rotation speed is increased by advancing the ignition timing by a constant amount when feedback control has stopped so as to increase output power.

However in this case, if load fluctuations occur and the engine rotation speed largely fluctuates when feedback control has stopped, the rotation speed may still fall below the target rotation speed even when the ignition timing is advanced as feedback control is not active.

If for example the intake air volume is largely increased when feedback control has stopped so as to prevent drop of rotation speed, the engine rotation speed increases when load fluctuations do not occur so that drivability and fuel cost-performance are impaired.

SUMMARY OF THE INVENTION

It is therefore an object of this invention to improve the characteristics of feedback control when idle rotation speed temporarily rises sharply due to a sharp decrease of load.

It is a further object of this invention to improve the precision of idle rotation speed control by a control which reflects various driving conditions.

In order to achieve the above objects, this invention provides a controller for feedback-controlling a rotation speed during idle running of a vehicle engine. The controller comprises a mechanism for detecting a vehicle running condition, a mechanism for setting a first target rotation speed during idle running of the engine according to the running condition, a mechanism for setting a second target rotation speed which progressively approaches the first target rotation speed from a predetermined first rotation speed, a mechanism for detecting an engine rotation speed, a mechanism for varying the engine rotation speed, and a mechanism for feedback-controlling the engine rotation speed via the varying mechanism so that the engine rotation speed converges to the second target rotation speed.

It is preferable that the first rotation speed is set to the engine rotation speed when the feedback control starts.

It is also preferable that the feedback control mechanism comprises a mechanism for performing integral control.

It is also preferable that the second target rotation speed setting mechanism comprises a mechanism for setting the second target rotation speed according to factors which affect the drop of the engine rotation speed to an idle rotation speed.

It is also preferable that the second target rotation speed setting mechanism comprises a mechanism for setting as the second target rotation speed, a value which follows the first target rotation speed by a delay equation with a predetermined time constant using the first rotation speed as an initial value, and the varying mechanism comprises a mechanism for varying an intake air volume of the engine.

It is also preferable that the second target rotation speed setting mechanism comprises a mechanism which sets the time constant to be larger the larger the inertial moment of the engine.

In this case, it is further preferable that the second target rotation speed setting mechanism comprises a mechanism which sets the time constant to be larger the larger the inertial moment of a drive system of the vehicle when the engine is connected to the drive system.

It is also preferable that the second target rotation speed setting mechanism comprises a mechanism which sets the time constant to be larger the larger a collector capacity of the engine.

It is also preferable that the second target rotation speed setting mechanism comprises a mechanism which sets the time constant based on the vehicle running condition.

In this case, it is further preferable that the vehicle running condition detecting mechanism comprises a mechanism for detecting a cooling water temperature of the engine, and the second target rotation speed setting mechanism comprises a mechanism which sets the time constant to be smaller the lower the cooling water temperature.

It is also preferable that the vehicle running condition detecting mechanism comprises a mechanism for detecting a voltage of a battery charged by the running of the engine, and the second target rotation speed setting mechanism comprises a mechanism which sets the time constant to be smaller the lower the battery voltage.

It is also preferable that the vehicle running condition detecting mechanism comprises a mechanism for detecting a deceleration of the vehicle when the engine and a drive system of the vehicle are connected, and the second target rotation speed setting mechanism comprises a mechanism which sets the time constant to be smaller the larger the deceleration.

It is also preferable that the vehicle running condition detecting mechanism comprises a mechanism for detecting a deceleration of the engine when the engine and a drive system of the vehicle are connected, and the second target rotation speed setting mechanism comprises a mechanism which sets the time constant to be smaller the larger the deceleration.

It is also preferable that the vehicle running condition detecting mechanism comprises a mechanism for detecting an accessory load of the engine, and the second target rotation speed setting mechanism comprises a mechanism which sets the time constant to be smaller the larger the accessory load.

It is also preferable that the second target rotation speed setting mechanism comprises a mechanism for setting a plurality of time constants based on a plurality of conditions, and a mechanism for applying a time constant equal to or greater than a maximum value of the time constants to the delay equation.

It is also preferable that the vehicle running condition detecting mechanism comprises a mechanism for detecting a rotation speed of the engine, and the second target rotation speed setting mechanism comprises a mechanism for applying a rotation speed lower than the present engine rotation speed to the second target rotation speed in a predetermined speed region above a second rotation speed which is higher than the first rotation speed.

In this case, it is further preferable that the feedback control mechanism comprises a mechanism for applying a value smaller than a feedback gain used in a rotation speed region below the second rotation speed, to a feedback gain applied to feedback control in a region where the engine rotation speed is higher than the second rotation speed.

It is also preferable that the applying mechanism comprises a mechanism for storing the second target rotation speed immediately prior to when the engine rotation speed rises above the second rotation speed, and a mechanism for applying a stored value stored by the storing mechanism to the second target rotation speed from when the engine rotation speed rises above the second rotation speed to when the engine rotation speed falls below the second rotation speed.

It is also preferable that the vehicle running condition detecting mechanism comprises a mechanism for detecting a sharp decrease of engine load and a mechanism for detecting an engine rotation speed, and the second target rotation speed setting mechanism comprises a mechanism for measuring an elapsed time from when the engine load sharply decreases and a mechanism for using a rotation speed lower than an engine rotation speed detected by the engine rotation speed detecting mechanism, as the second target rotation speed until the elapsed time reaches a predetermined time.

In this case, it is further preferable that the feedback control mechanism comprises a mechanism for applying a value smaller than a feedback gain prior to a sharp decrease of the engine load, to a feedback gain applied to feedback control, from when the engine load decreases sharply to when the elapsed time reaches the predetermined time.

It is also preferable that the applying mechanism comprises a mechanism for storing the second target rotation speed immediately prior to a sharp decrease of the engine load, and a mechanism for applying a stored value stored by the storing mechanism to the second target rotation speed until the elapsed time reaches the predetermined time.

It is also preferable that the sharp load decrease detecting mechanism comprises a mechanism for detecting a shift-down of an automatic transmission with which the vehicle is provided.

It is also preferable that the vehicle running condition detecting mechanism comprises a mechanism for detecting an engine rotation speed, and the second target rotation speed setting mechanism comprises a mechanism for applying the first target rotation speed to the second target rotation speed when the engine rotation speed is less than the first target rotation speed.

In this case, it is further preferable that the feedback control mechanism comprises a mechanism for applying a value smaller than a feedback gain in a rotation speed region above the first target rotation speed, to the feedback gain applied to feedback control, in a region where the engine rotation speed is less than the first target rotation speed.

The details as well as other features and advantages of this invention are set forth in the remainder of the specification and are shown in the accompanying drawings.

DESCRIPTION OF THE PREFERRED EMBODIMENTS

Figure 1:
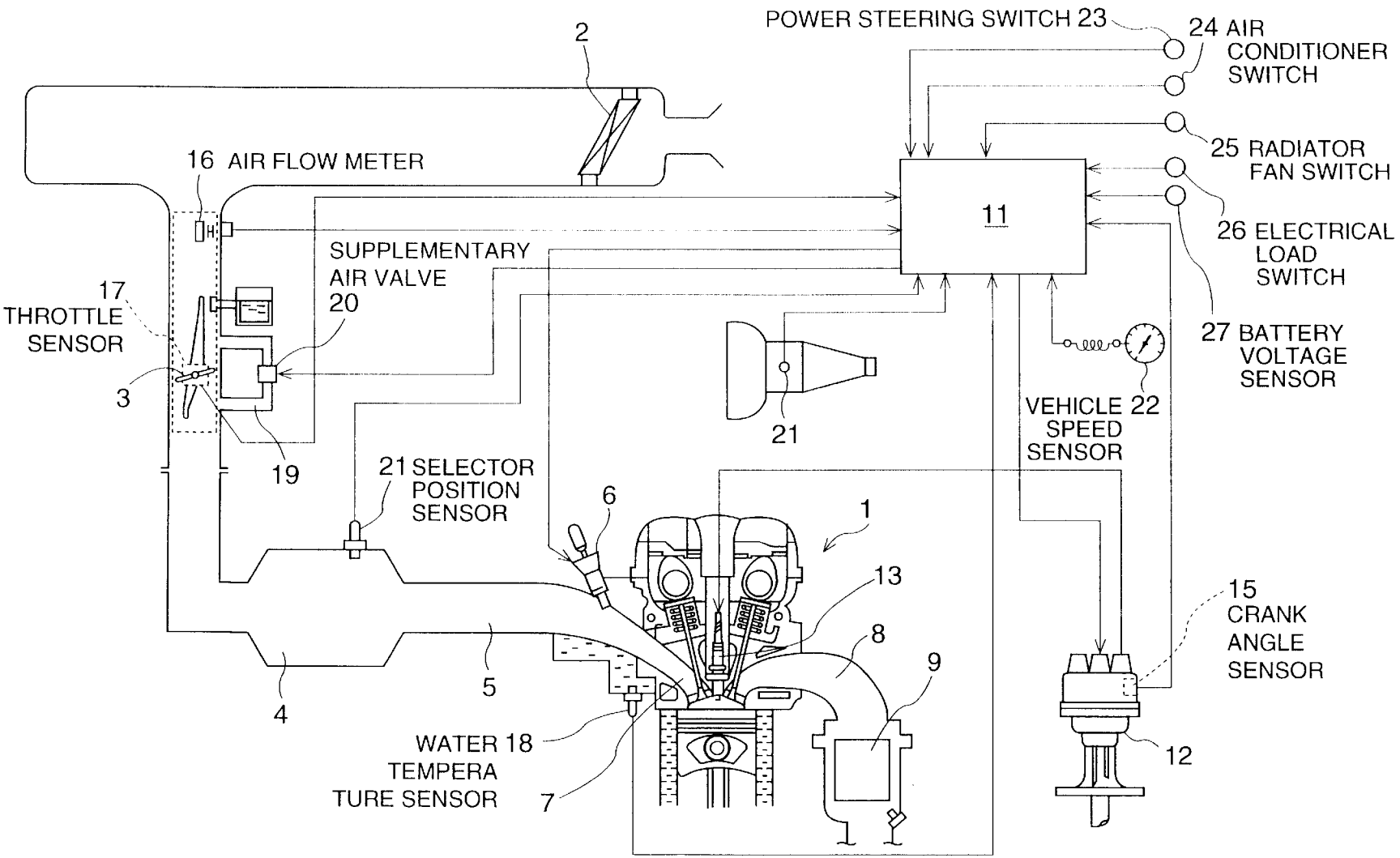
FIG. 1 is a schematic diagram of an idle rotation speed controller according to this invention.

Referring to FIG. 1 of the drawings, intake air for a multi-cylinder engine 1 of a vehicle flows into each cylinder of the engine through an intake passage comprising an air cleaner 2, throttle 3, collector 4, intake manifold 5 and intake port 7.

The throttle 3 operates in synchronism with an accelerator pedal, not shown, so as to vary an intake air flowrate according to the operation of the accelerator by the driver.

Fuel is injected toward the intake port 7 from a fuel injection valve 6 based on an injection pulse signal sent from an electronic control unit (referred to hereafter as ECU) 11.

The fuel-air mixture which has flowed into the cylinder is ignited by a spark plug 13. The electric current for activating the spark plug 13 is provided from a distributor 12.

A power transistor and an ignition coil, not shown, are built into the casing of the distributor 12. The power transistor supplies current from a battery of the automobile to the ignition coil according to an ignition signal sent from the ECU 11. The spark plug 13 is provided for each cylinder, and the ignition coil sends out a high-voltage current to the spark plug 13 in each cylinder in a predetermined ignition sequence via the distributor 12.

The ignition timing of the spark plug 13 is therefore based on the input timing of the ignition signal from the ECU 11 to the power transistor.

The distributor 12 operates in synchronism with the camshaft of the engine 1, and connects the spark plug 13 of each cylinder to the ignition coil in the ignition sequence according to a crank angle.

The fuel-air mixture which was burnt in the cylinder is discharged as exhaust gas to an exhaust passage 8, and thence to the atmosphere via a three-way catalytic converter 9. The three-way catalytic converter 9 oxidizes or reduces hydrocarbons (HC), carbon monoxide (CO) and nitrogen oxides (NOx) in the exhaust gas so as to convert them to harmless substances, A crank angle sensor 15 which detects the crank angle of the engine 1 is built into the distributor 12. The crank angle sensor 15 inputs a Ref signal denoting a predetermined crank angle and a unit angle signal showing a crank angle variation every one degree to the ECU 11.

Other signals also input to the ECU 11 are an intake air volume signal from an air flow meter 16 provided in the intake passage of the engine 1, a throttle opening signal from a throttle sensor 17 fitted to the throttle, a cooling water temperature signal from a water temperature sensor 18 attached to a water jacket of the engine 1, a selector position signal from a selector position sensor 21 which detects the selector position of an automatic transmission of the vehicle, a vehicle speed signal from a vehicle speed sensor 22 which detects a vehicle speed, a power steering hydraulic pressure sensor from a power steering switch 23 which responds to a power steering of the vehicle, an air conditioner switch signal from an air conditioner switch 24 which shows whether or not an air conditioner is operating, a radiator fan switch signal from a radiator fan switch 25 which shows whether or not a radiator fan is operating, an electrical load signal from an electrical load switch 26 which shows whether or not main electrical devices such as the headlamps are operating, and a battery voltage signal from a battery voltage sensor 27 which detects a voltage of the battery.

Based on these signals, the ECU 11 controls a fuel injection amount, i.e. it controls an air-fuel ratio of the fuel-air mixture supplied to the cylinder, and the ignition timing of the fuel-air mixture while determining the driving conditions. The ECU 11 also controls an engine rotation speed during idle running such that it is maintained within an appropriate range.

The idle engine rotation speed control by the ECU 11 will now be described.

In this controller, the idle engine speed is controlled by controlling the intake air volume and the ignition timing mentioned hereafter.

To control intake air volume, a supplementary air passage 19 is provided which by-passes the throttle valve 3 in the intake passage of the engine 1, and a rotary solenoid type supplementary air valve 20 is provided which is directly activated by a pulse signal from the ECU 11. The supplementary air valve 20 switches ON and OFF according to this pulse signal, and increases a supplementary air amount according to the proportion of ON time.

The ECU 11 sets a target engine rotation speed during idle running according to the cooling water temperature signal, elapsed time after engine startup, battery voltage signal, power steering switch signal, air conditioner switch signal, and selector position signal. When idle rotation speed feedback control conditions hold, an ON time ratio of the pulse signal output to the supplementary air valve 20, i.e. a feedback correction amount of an ON duty, is calculated such that the engine rotation speed of the engine 1 coincides with the target rotation speed during idle running. A basic value of the ON duty of the supplementary air valve 20 is then revised using this correction amount.

In practice, the supplementary air valve 20 is not a single valve but a group of valves containing other valves which are not shown.

Figure 2:
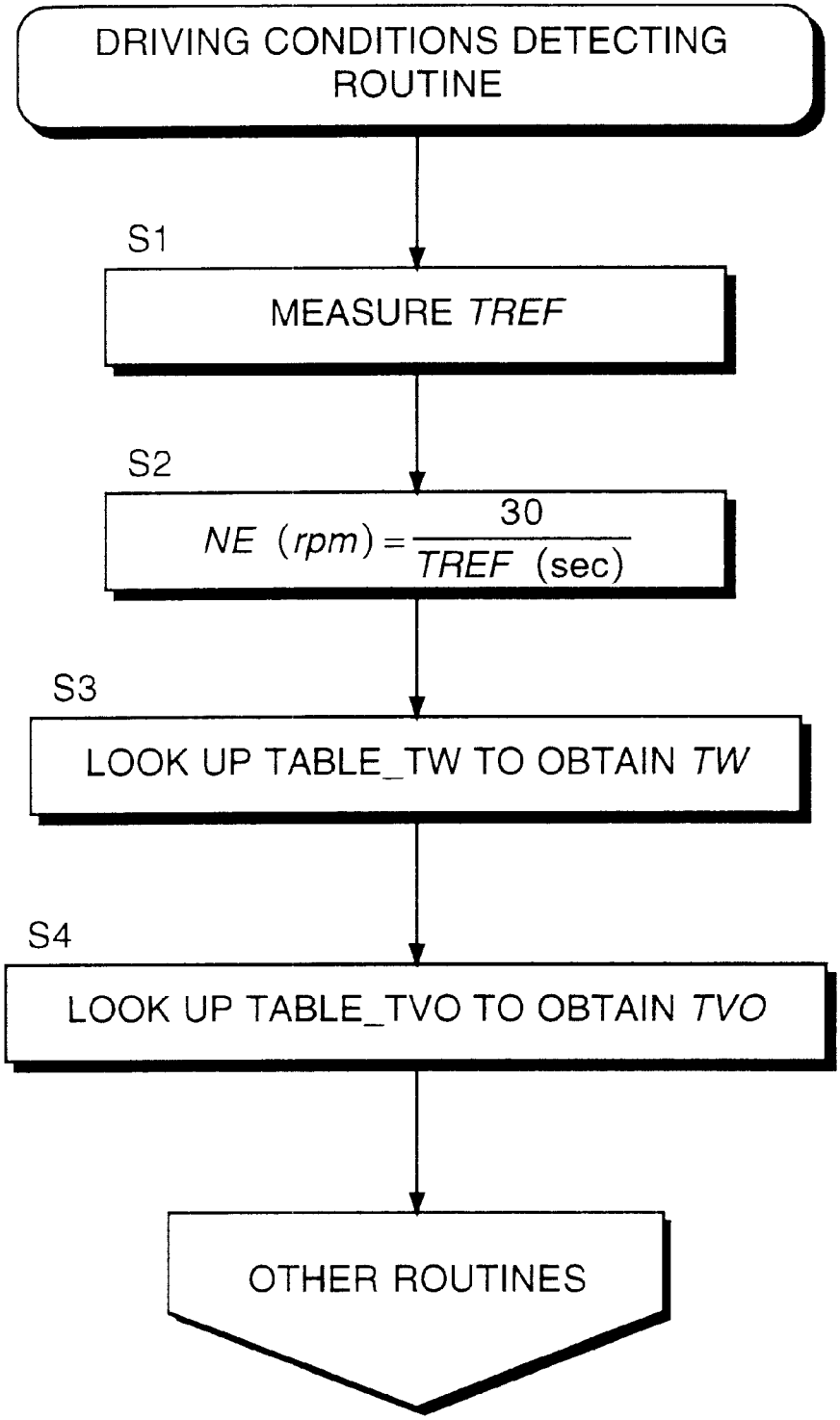
FIG. 2 is a flowchart describing a process of detecting an engine running condition executed by the idle rotation speed controller.

Next, the process for setting the target rotation speed during idle running which is a feature of this invention will be described with reference to flowcharts. The flowchart of FIG. 2 shows a process for detecting driving conditions. This routine is executed as an interrupt job triggered by the Ref signal.

First, in a step S1, an interval TREF (sec) between Ref signals is measured by a timer built into the ECU 11. In the case of a four-stroke cycle, four-cylinder engine, the Ref signal is output at a crank angle of every 180°, while in the case of a four-stroke cycle, six-cylinder engine it is output at a crank angle of every 120°.

In a step S2, the engine rotation speed NE(rpm) is calculated by the following equation.

$$NE(\text{rpm}) = \frac{30}{TREF(\text{sec})} \tag{1}$$

In a step S3, a predetermined table TABLE_TW is looked up from the cooling water temperature signal so as to determine the cooling water temperature TW. In a step S4, a predetermined table TABLE_TVO is looked up from the signal output by the throttle 17 so as to determined a throttle opening TVO. The table TABLE_TW is used to convert the signal output by the water temperature sensor 18 to a cooling water temperature, and the TABLE_TVO is used to convert the signal output by the throttle 17 to a throttle opening. These tables are pre-stored in the ECU 11 as ROM data.

All the tables mentioned hereafter are also stored in the ECU 11 as ROM data.

Figure 3:
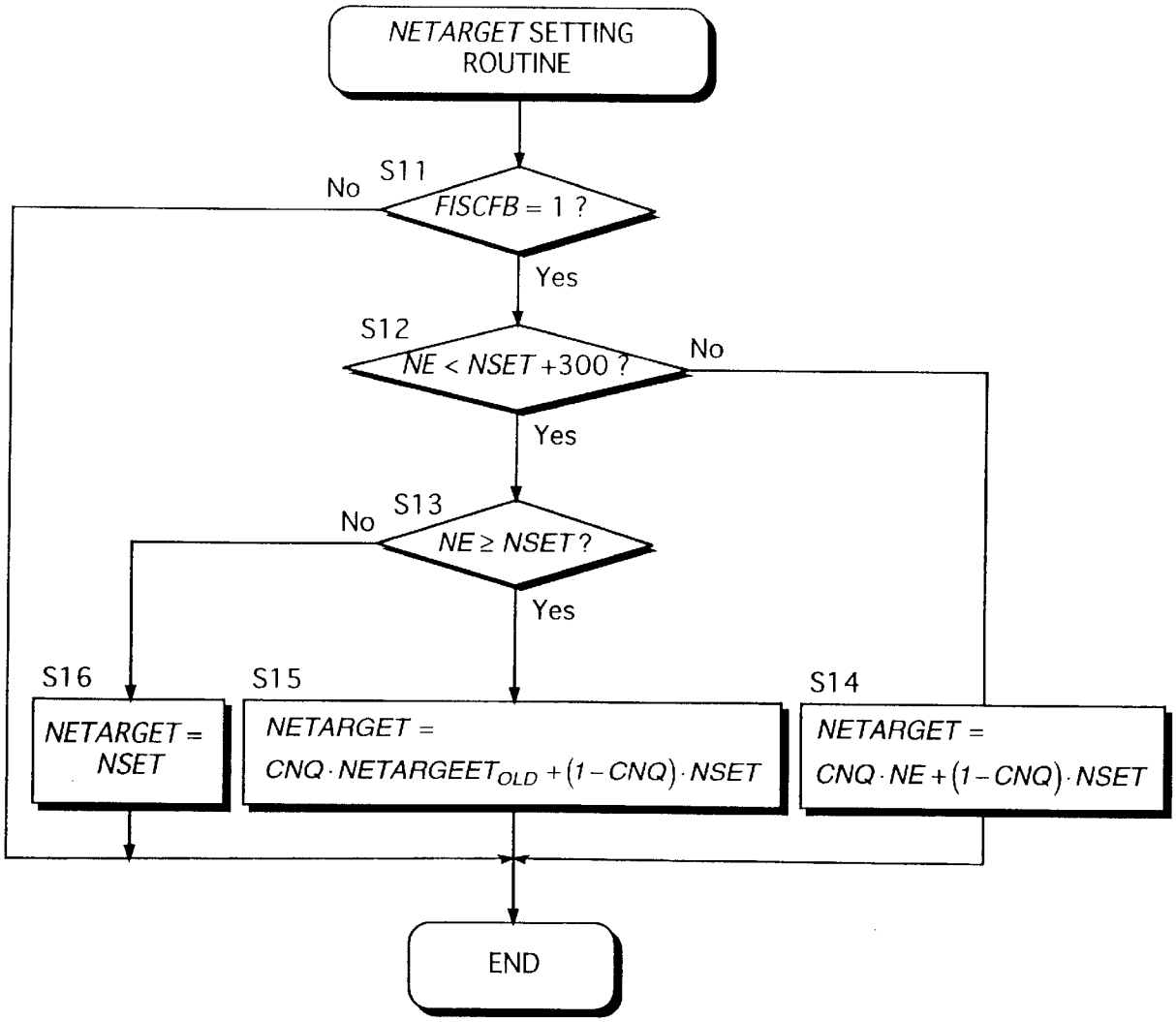
FIG. 3 is a flowchart describing a process of calculating a second target rotation speed NETARGET executed by the idle rotation speed controller.

The flowchart of FIG. 3 shows a process for setting a second target engine speed NETARGET. This routine is also executed as a Ref signal interrupt job. Although a full description will not be given here, as the ECU 11 performs the process of setting the ignition timing as a Ref signal interrupt job, the feedback control routine that uses the ignition timing control mechanism is also performed as a Ref interrupt job. The second target rotation speed NETARGET which is required for this purpose is also computed by a Ref signal interrupt job.

First, in a step S11, it is judged whether or not a feedback flag FISCFB is 1. When the feedback flag FISCFB=1, idle rotation speed feedback control conditions hold. The feedback flag FISCFB is initialized to "0" on engine startup. The feedback flag FISCFB is set based on the vehicle speed, engine rotation speed NE and throttle opening TVO by another 10 ms job, not shown. In this job, when both of the following conditions (1) and (2) hold, the flag FISCFB is set to "1", otherwise if either one of the two conditions does not hold the flag FISCFB is reset to "0".

Condition (1): The throttle opening TVO is 0%.

Condition (2): The vehicle is in neutral, or the engine rotation speed is equal to or less than a first engine speed N1, where N1 is constant.

When the vehicle is in neutral, the rotation speed when the throttle is fully closed is the feedback control start rotation speed. When the vehicle is not in neutral, and the engine rotation speed is equal to or less than the first rotation speed N1 before the throttle is fully closed, the rotation speed when the throttle is fully closed is the feedback control start rotation speed.

When FISCFB=1 in the step S11, i.e. when idle rotation speed feedback control conditions hold, it is determined in steps S12, S13 whether the engine rotation speed is in one of the following engine speed regions:

(i) NSET+300 (rpm)≦NE (ii) NSET≦NE<NSET+300 (rpm)

(iii) NE≦NSET

Figure 4:
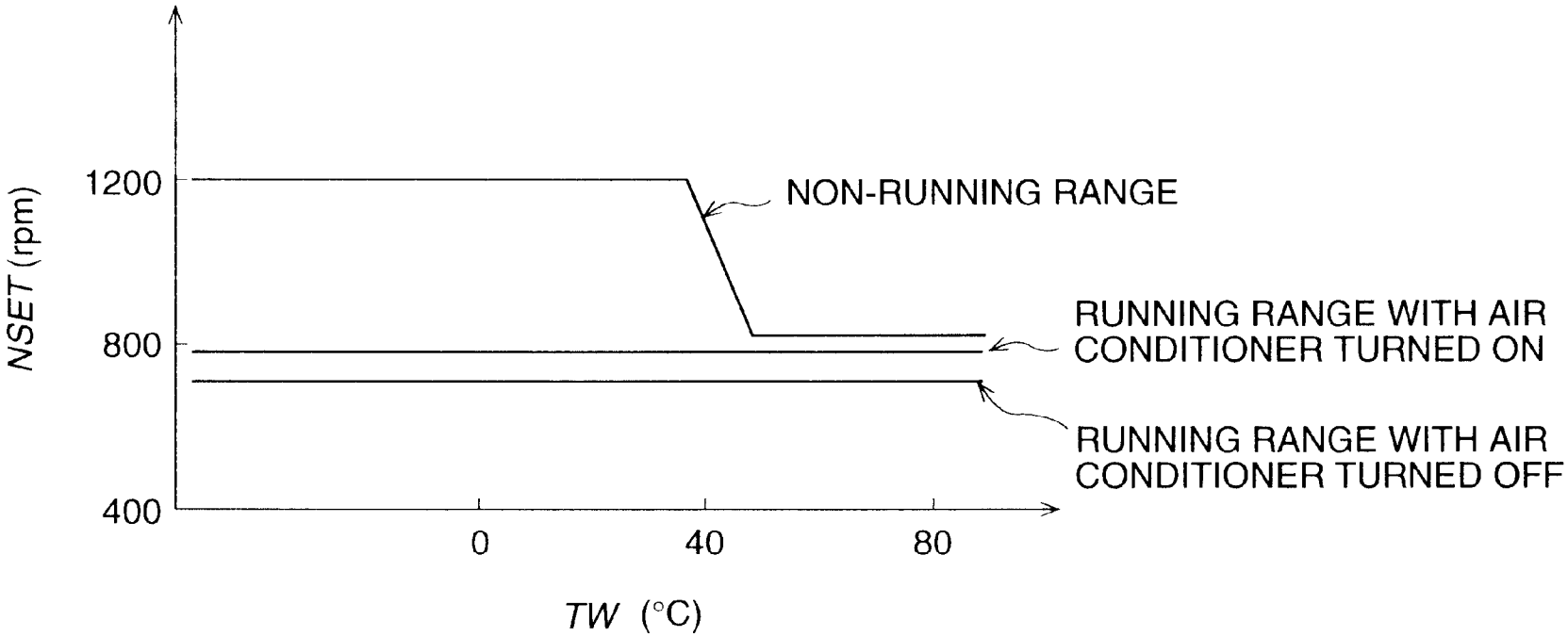
FIG. 4 is a graph showing the characteristics of a first target rotation speed NSET set by the idle rotation speed controller.

Herein, a first target engine speed NSET corresponds to the idle rotation control target speed of the prior art, and it is preset based on the cooling water temperature TW, elapsed time after startup, battery voltage, power steering switch, air conditioner switch and selector position of the automatic transmission. For example, as shown in FIG. 4, when the selector position is in a running range and the air conditioner starts operating from a nonoperating state, NSET is increased by predetermined value. Further, when the cooling water temperature is low, i.e. about 40° C. or below, and the selector position is in the non-running range, creep is not a problem so NSET is increases so as to stabilize idle running, Creep refers to a phenomenon in the idle running state wherein, although the accelerator pedal is not depressed in the vehicle running range, the vehicle moves forward due to the engine drive force which is transmitted via the automatic transmission.

When it is determined in a step S12 that the engine rotation speed NE is in the aforesaid rotation speed region (i), the routine proceeds to a step S14, and a second target engine speed NETARGET is calculated by the following equation (2).

$$\text{NETARGET}=\text{CNQ}\cdot\text{NE}+(1-\text{CNQ})\cdot\text{NSET} \tag{2}$$

When it is determined in a step S13 that the engine rotation speed NE is in the rotation speed region (ii), the routine proceeds to a step S15, and the second target rotation speed NETARGET is calculated by the following equation (3).

$$\text{NETARGET}=\text{CNQ}\cdot\text{NETARGEET}_{OLD}+(1-\text{CNQ})\cdot\text{NSET} \tag{3}$$

where, CNQ=weighted average coefficient (absolute number)

$\text{NETARGEET}_{OLD}$=NETARGET on immediately preceding occasion.

When it is determined in the step S13 that the engine rotation speed NE is in the rotation speed region (iii), the routine proceeds to a step S16, and the first target rotation speed NSET is taken as the second target engine speed NETARGET.

The weighted average coefficient CNQ of equation (2) is a value defined by 0<CNQ≦1.

NETARGET in equation (2) is the first target value of the feedback control start time. On the other hand, NETARGET which is computed cyclically in equation (3) is the second target value. Therefore when a change-over is made from NETARGET in equation (2) to NETARGET in equation (3), the same value of CNQ is used to avoid producing a discrepancy. As a result, NETARGET in equation (3) approaches the first target rotation speed NSET with a first order delay and the value of NETARGET obtained by equation (2) as an initial value immediately before NE reaches NSET+300 i.e. a second target speed N2.

The reason why the second target value is given by NSET with a first order delay is as follows. When there is a change-over from a variation of intake air volume to a variation of rotation speed, there is a second order delay element in the response. Therefore, the second target rotation speed should be set to follow the first target rotation speed with a second order delay, however as the same result is obtained by approximating this second order delay by a first order delay, a first order delay has been used in the calculation for the sake of simplicity.

Figures 8A, 8B:
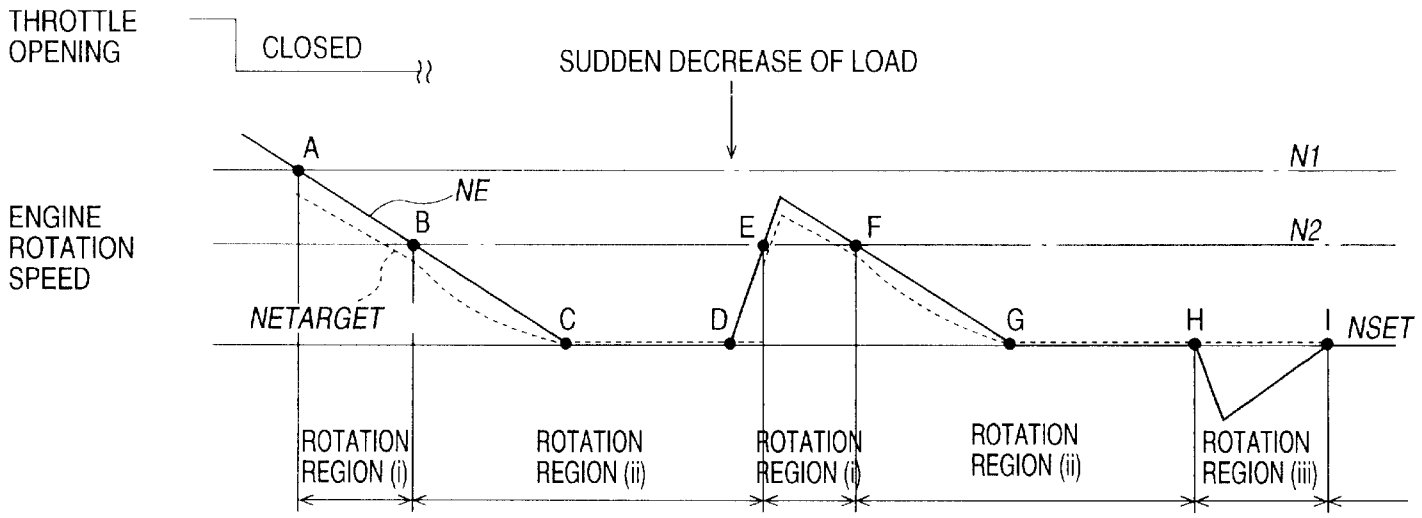
FIGS. 8A and 8B are timing charts describing changes of throttle opening and engine rotation speed under the control of the idle rotation speed controller.

Herein, it shall be described how the second target rotation speed NETARGET is set using an example with reference to FIGS. 8A, 8B. FIG. 8B assumes the following scenarios.

[1] The vehicle is coasting or decelerating, feedback control conditions hold, and a transition to the idle state occurs, as shown by the left-hand part of FIG. 8B.

[2] The engine rotation speed has effectively fallen to NSET, and the engine rotation speed NE temporarily rises to NETARGET+300 (=N2) due to a sudden decrease of load as a result of shift-down, as shown by the middle part of FIG. 8B.

[3] The engine rotation speed NE has fallen below the first target rotation speed NSET due to load fluctuations, etc., as shown by the right-hand part of FIG. 8B.

To simplify the description, it shall be assumed that NSET is constant.

First, in the case of [1] above, feedback control of idle rotation speed starts at a point A, then the engine rotation speed NE falls with an effectively linear decrease as shown by the solid line in the figure so as to reach the first target rotation speed NSET at a point C. The second target rotation speed NETARGET shown by the broken line in the figure takes a value obtained by the aforesaid equation (2), and follows NSET with a first order delay from the point B. In the case of [2] above, the second target rotation speed NETARGET is maintained at NSETbetween D and E, and then obtained by the aforesaid equation (2) between E and F, and follows NSET with a first order delay from a point F. Therefore NETARGET is set between NE and NSET in both case [1 ] and [2].

On the other hand, in the case [3] above,

NETARGET coincides with NSET between H and I.

The weighted average coefficient CNQ in the above equation (3) corresponds to a response time constant. For example, the larger CNQ, the slower NETARGET approaches NSET, and conversely the smaller CNQ, the more rapidly NETARGET approaches NSET.

CNQ is set based on factors which are affected by the drop of engine rotation speed in the idle state. These factors are for example the engine inertial moment, inertial moment of a drive system of the vehicle, collector capacity, cooling water temperature, battery voltage, deceleration of engine rotation speed, deceleration of vehicle speed, presence or absence of a link between the engine and drive system, and presence or absence of a link between an accessory load and the engine.

For example, in any of the following cases I–III, engine rotation speed falls slowly when there is a transition to the idle state. Hence, by increasing CNQ to match the slow response, i.e. by increasing the time constant, the second target rotation speed NETARGET is made to approach the first target rotation speed NSET slowly.

I. The engine inertial moment is large.

II. Inertial moment of drive system is large when the engine and drive system are connected.

III. The collector capacity is large.

Conversely, in any of the following cases IV–VII, engine rotation speed falls rapidly when there is a transition to the idle state. Hence, by decreasing CNQ to match the fast response, i.e. by increasing the time constant, the second target rotation speed NETARGET is made to approach the first target rotation speed NSET rapidly.

IV. Cooling water temperature is low (engine friction, etc., is high)

V. Battery voltage is low (alternator current is large and load on engine increases)

VI. Engine is connected to drive system, and deceleration of vehicle speed and deceleration of engine rotation speed are large.

VII. Another instrument is driven by the engine.

By setting the weighted average coefficient CNQ in this way, the variation of NETARGET is made to approach the actual decrease of the engine rotation speed NE in any of these cases. The value of the weighted average coefficient CNQ is separately determined in each of the cases I–VII. To determine the value of CNQ taking all of the conditions I–VII into account, the highest value is selected from the values of CNQ set for each condition.

In this way, the intake air volume is always made to decrease slowly, i.e. the intake air volume is set rather high. This is done in order to suppress drops of rotation speed when load increases during feedback control of the idle rotation speed. A stable idle rotation speed is thereby maintained.

When the value of the weighted average coefficient CNQ is determined taking account of only one of the conditions I–VII, the idle rotation speed can be stabilized by using a value of CNQ slightly larger than the optimum value for that condition.

Figure 5:
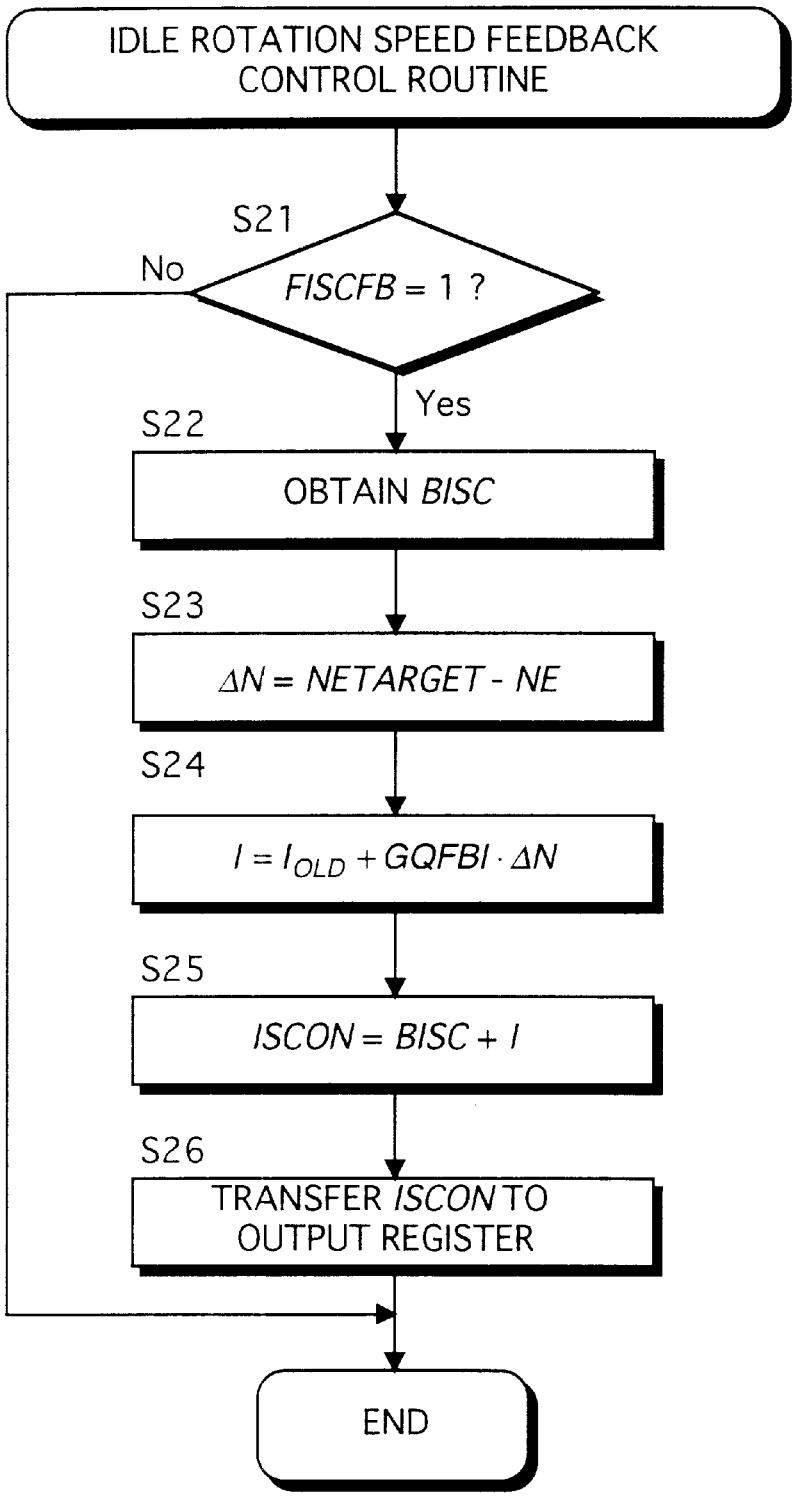
FIG. 5 is a flowchart describing an intake air volume feedback control process executed by the idle rotation speed controller.

The flowchart of FIG. 5 shows a process for feedback control of the idle rotation speed using the supplementary air valve 20. This routine is executed as a Ref signal interrupt job after the routine of FIG. 3.

For example, the routine of FIG. 3 is started by input of one Ref signal, and after computing the current value of NETARGET, the supplementary air valve 20 is controlled by the routine of FIG. 5 using this NETARGET. When the next Ref signal is input, NETARGET is again computed by the routine of FIG. 3, and the routine of FIG. 5 is performed using this computed value of NETARGET. to simplify the description with regard to feedback control, integral control will be assumed.

First, in a step S21, the feedback flag FISCFB is determined. When FISCFB=1, i.e. when idle rotation speed feedback control conditions hold, the routine proceeds to a step S22, and a basic value BISC(%) of an ON duty supplied to the supplementary air valve 20 is found. The basic value BISC(%) is looked up from a table preset according to the cooling water temperature, etc.

In a step S23, a difference ΔN(rpm) between the second target rotation speed NETARGET obtained in the routine of FIG. 3 and the engine rotation speed NE is calculated.

In a step S24, an integral part I (%) of an ON duty feedback correction amount of the supplementary air valve 20 is found by the following equation (4).

$$I=I_{OLD}+GQFBI\cdot\Delta N \quad (4)$$

where, $I_{OLD}$=immediately preceding value of I

GQFBI=integral gain

In a step S25, an ON duty ISCON(%) is calculated by the following equation (5).

$$ISCON=BISC+I \quad (5)$$

where, BISC=Feed foward (open loop) correction value according to water temperature, obtained from a table In a step S6, this ISCON is transferred to a supplementary air valve control output register.

In this embodiment, the integral gain GQFBI in equation (4) is set to be equal to a constant value GQFBN in any of the aforesaid rotation speed regions (i), (ii), (iii). The integral part I is initialized to O during startup.

During integral control, when the engine rotation speed NE is less than the second target rotation speed NETARGET, the engine torque is increased by increasing the integral part I, i.e. by increasing the flowrate through the supplementary air valve 20. On the other hand when the engine rotation speed NE is higher than the second target rotation speed NETARGET, the engine torque is decreased by decreasing the integral part I, and the idle rotation speed is thereby made to converge to the second target rotation speed NETARGET.

Figure 6:
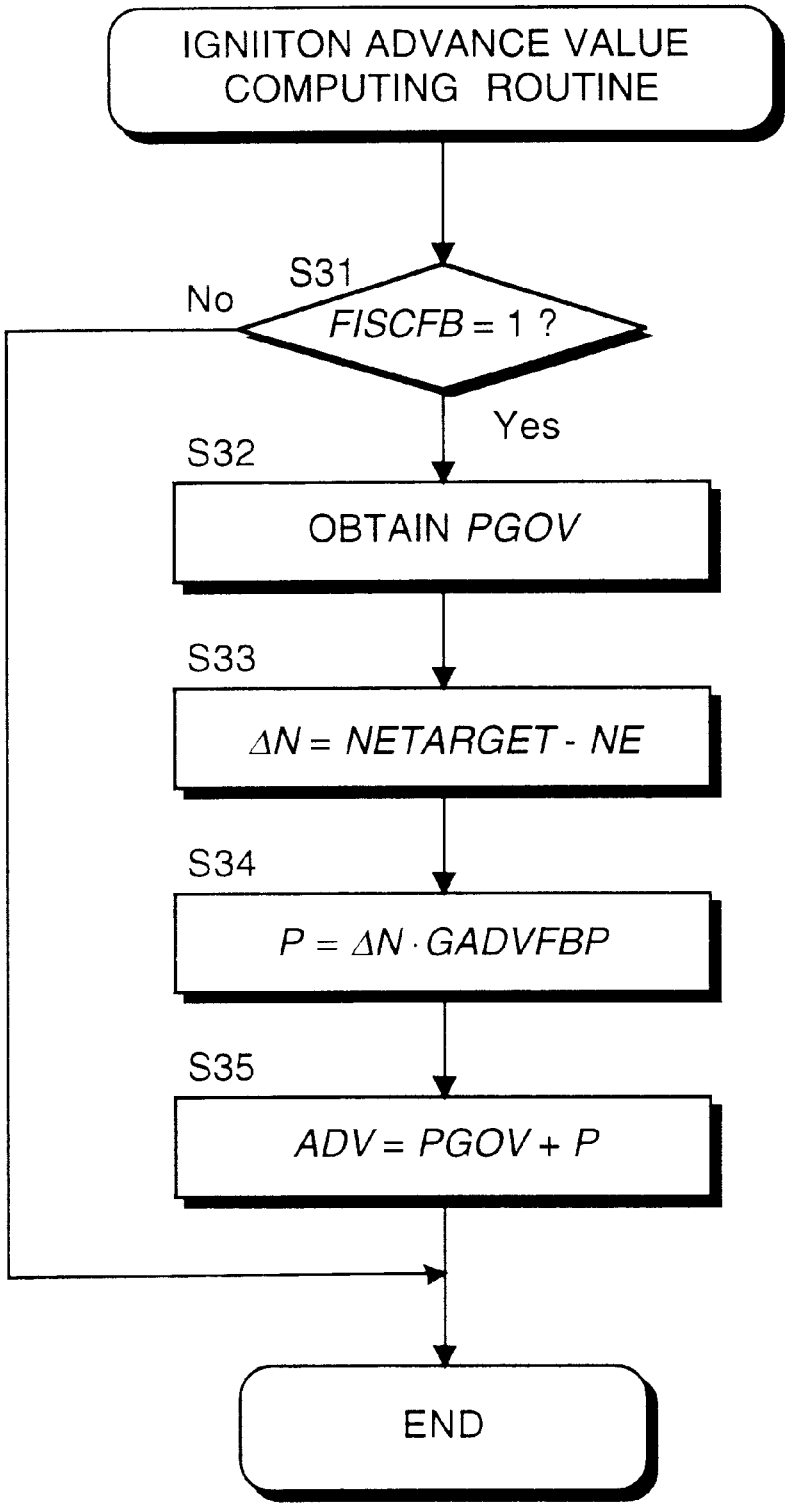
FIG. 6 is a flowchart describing an ignition timing control process executed by the idle rotation speed controller.

The flowchart of FIG. 6 shows a process for computing an ignition advance value ADV when idle rotation speed feedback control is performed by ignition timing control. This routine is executed as a Ref signal interrupt job after the routine of FIG. 5. Idle rotation speed feedback control performed by ignition timing control is a direct proportion control.

The reason why feedback control by ignition timing control is performed in addition to feedback control using the supplementary air valve 20, is that in feedback control using the valve 20 there is a response delay from when the intake air volume increases to when the engine torque increases, and this can be compensated by ignition timing control which has a rapid response.

In a step S31, the feedback flag FISCFB is determined, and when FISCFB=1, i.e. when idle rotation speed feedback control conditions hold, the routine proceeds to a step S32.

Figure 7:
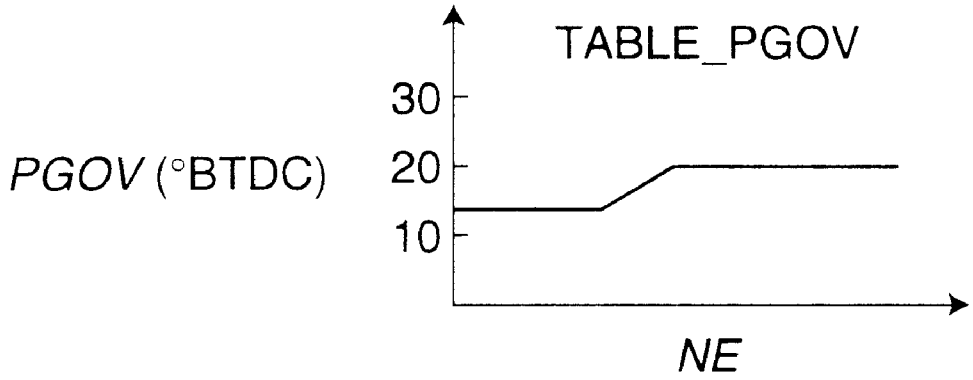
FIG. 7 is a graph showing the contents of a table of a basic ignition advance value PGOV during idle running stored by the idle rotation speed controller.

In the step S32, a TABLE_PGOV shown in FIG. 7 is looked up from the engine rotation speed NE, and a basic ignition advance value PGOV (°BTDC) in the idle state is found. PGOV is a feed foward (open loop) correction value dependent on the engine rotation speed. (°BTDC) used as the units of ignition advance value refers to the number of degrees before top dead center of the compression stroke of the engine piston.

In a step S33, a difference ΔN between the second target rotation speed NETARGET obtained in the routine of FIG. 3 and the engine rotation speed NE is calculated. In a step S34, a proportional amount P (°) of an ignition timing feedback amount is found by the following equation (6).

$$P=\Delta N\cdot GADVFBP \quad (6)$$

where, GADVFBP=proportional gain

In a step S35, the ignition advance value ADV (°BTDC) is calculated by the following equation (7).

$$ADV=PGOV+P \quad (7)$$

Herein, ADV is a crank angle measured in the advance direction from top dead center of the compression stroke. This ADV is transferred to an ignition timing control output register, and when the crank angle before top dead center of the compression stroke coincides with ADV, the spark plug 13 is activated.

When the proportional part P is positive, equation (7) advances the ignition timing, conversely when the proportional part P is negative, equation (7) retards the ignition timing.

When the engine rotation speed NE is lower than the second target rotation speed NETARGET, the ignition timing is advanced to increase engine torque. Conversely, when the engine rotation speed NE is higher than the second target rotation speed NETARGET, the ignition timing is retarded to decrease engine torque. In this manner, the engine rotation speed NE is made to converge to the second target rotation speed NETARGET.

A specific feature of this invention resides in the process used for setting the target rotation speed, and hence this invention may be applied to any feedback control process of the idle rotation speed of an engine as far as it controls the idle speed to a predetermined target speed. Such an idle rotation speed feed back control is disclosed for example in Tokkai Hei 7-259616 published in 1995 by Japanese Patent Office.

According to this embodiment when there is a transition from coasting or deceleration to the idle state as shown in the left-hand part of FIG. 8B, and the engine rotation speed NE shown by the solid line in the figure is falling from the feedback control start rotation speed N1 to the second rotation speed N2=NSET+300 (rpm), the second target rotation speed NETARGET which is shown by the dotted line is given by the aforesaid equation (2).

After the engine rotation speed NE has reached the second rotation speed N2, the second target value NETARGET is set to a value which follows NSET with a first order delay.

Integral control is then performed using the supplementary air valve 20 so that the engine rotation speed NE coincides not with the first target rotation speed NSET but with the second target rotation speed NETARGET. As the integral part I is computed based on the difference ΔN (=NETARGET−NE) between the engine rotation speed NE and second target rotation speed NETARGET, the value of the integral part I calculated according to this invention is less than in the prior art where it is computed based on the difference between the engine rotation speed NE and first target rotation speed NSET.

The engine rotation speed NE may therefore be made to converge to the first target rotation speed NSET without dropping bellow the first target rotation speed NSET.

Figure 9A:
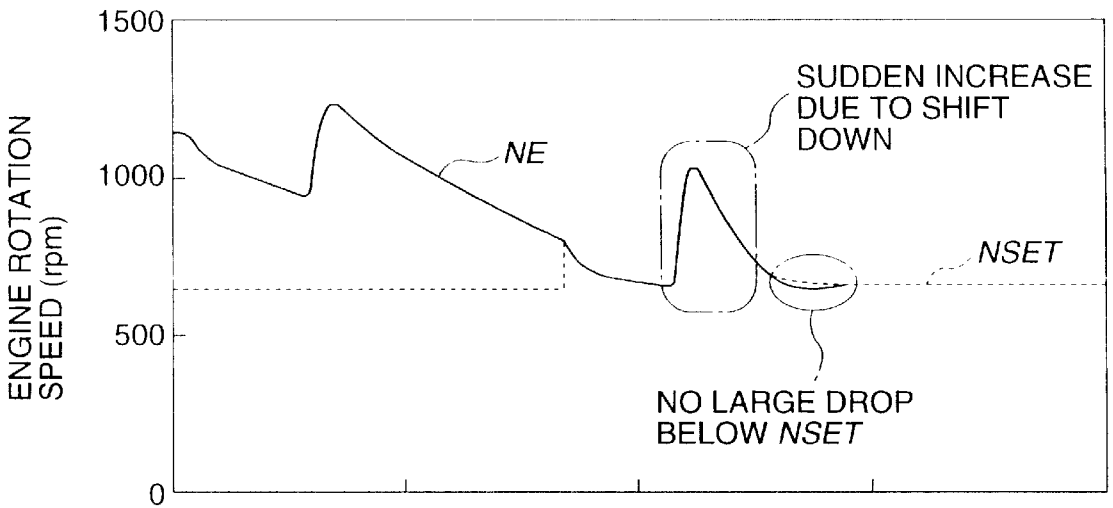
FIGS. 9A and 9B are timing charts showing changes of engine rotation speed and an intake air volume feedback correction amount under the control of the idle rotation speed controller.
Figure 9B:
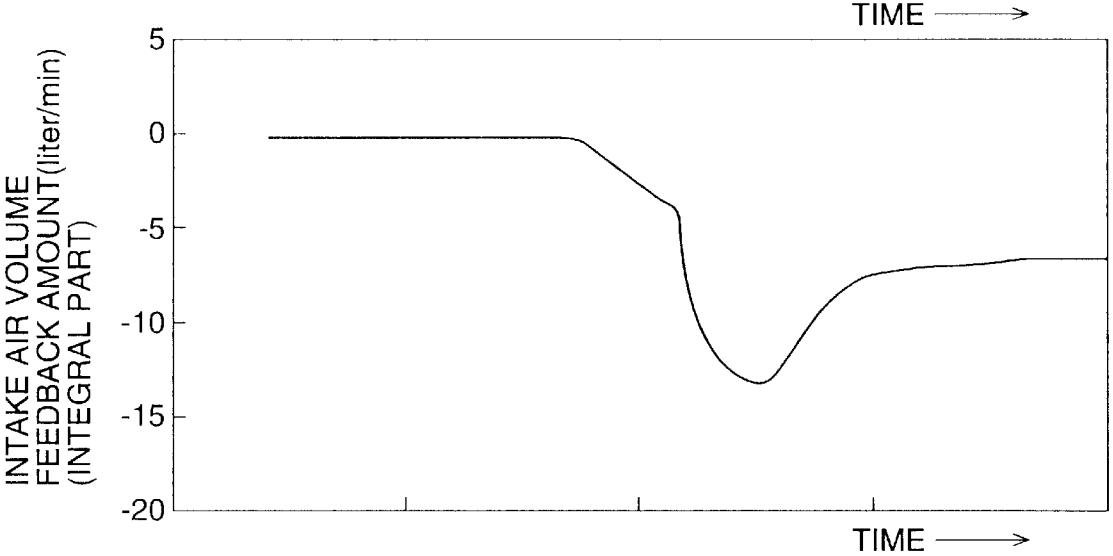

When the engine rotation speed has effectively fallen to NSET, the engine rotation speed NE, due to a sudden decrease of load as a result of shift-down. may temporarily increase to the second rotation speed N2 or higher. FIGS. 9A, 9B show the experimental results obtained when conditions such as integral gain in the controller of this invention are set equal to those of the prior art. According to the controller of this invention, NSET is set equal to NETARGET from when the engine rotation speed NE sharply rises to when it reaches the second target rotation speed NETARGET. When NE increases to N2 and above, the second target rotation speed NETARGET is set according to the aforesaid equation (2).

Then, from N2 to when NE reaches NSET, NETARGET is set equal to a value which follows NSET with a first order delay.

Hence, by performing integral control of the opening of the supplementary air valve 20 based on the value of NETARGET set in this way, the difference between the target rotation speed and engine rotation speed used for integral control is less than in the prior art, and excessive feedback correction is avoided.

As a result, even when a large increase of rotation speed occurs due to a shift-down under integral control as shown in FIG. 9A, the rotation speed converges to the first target rotation speed NSET without any large drops after the engine rotation speed NE reaches the first target rotation speed NSET.

Also, in this controller, feedback control is not stopped when shift down occurs, so the engine rotation speed does not fall much lower than the first target rotation speed NSET and converges to NSET even when engine load fluctuations occur during a shift-down.

Figure 10A:
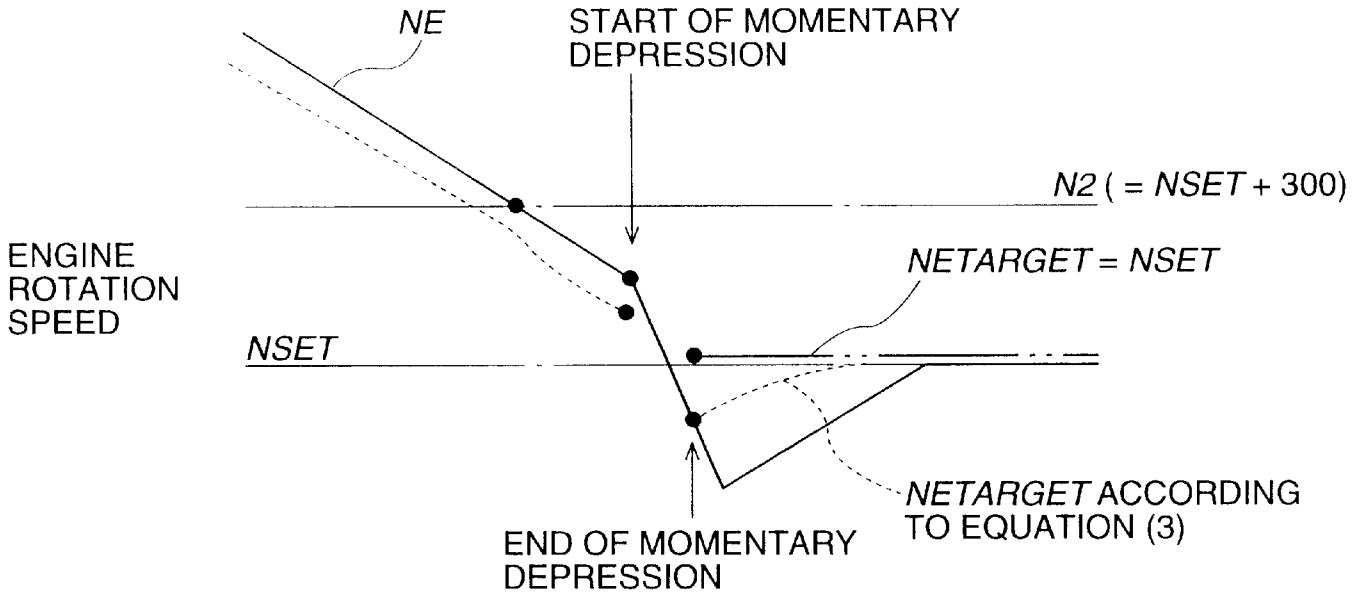
FIGS. 10A and 10B are timing charts describing changes of engine rotation speed and a feedback flag FISCFB when an accelerator is instantaneously depressed under the control of the idle rotation speed controller.
Figure 10B:
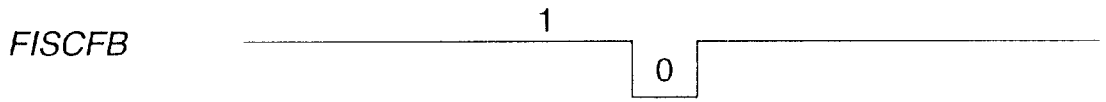

On the other hand, when the accelerator pedal is momentarily depressed during integral control, and there is a response delay in the air flow meter, this momentary depression causes a delay in fuel supply and the fuel mixture provided in the cylinder momentarily becomes lean. As a results, the engine rotation speed may temporarily fall as shown in FIGS. 10A and 10B.

In this case, when the second target rotation speed NETARGET is set by the aforesaid equation (3) using the engine rotation speed as an initial value after the accelerator is released, the time during which the engine rotation speed is less than the first target rotation speed NSET is longer as shown by the broken line in the figure, and there is an increased risk that the engine may stall.

However, as the engine rotation speed is less than the first target rotation speed NSET when the accelerator is released, according to this controller, the second target rotation speed NETARGET is set equal to the first target rotation speed NSET as shown by the double dotted line in the figure. Consequently, the difference ΔN used for integral control is larger than the difference obtained when the second target rotation speed NETARGET is set by the above equation (3) using the engine rotation speed when the accelerator is released as an initial value. The supplementary air flowrate is therefore increased by a corresponding amount, the time for which the engine rotation speed is less than the first target rotation speed NSET is shorter, and engine failure due to drops of engine rotation speed caused by accelerator operation are prevented.

Figure 11:
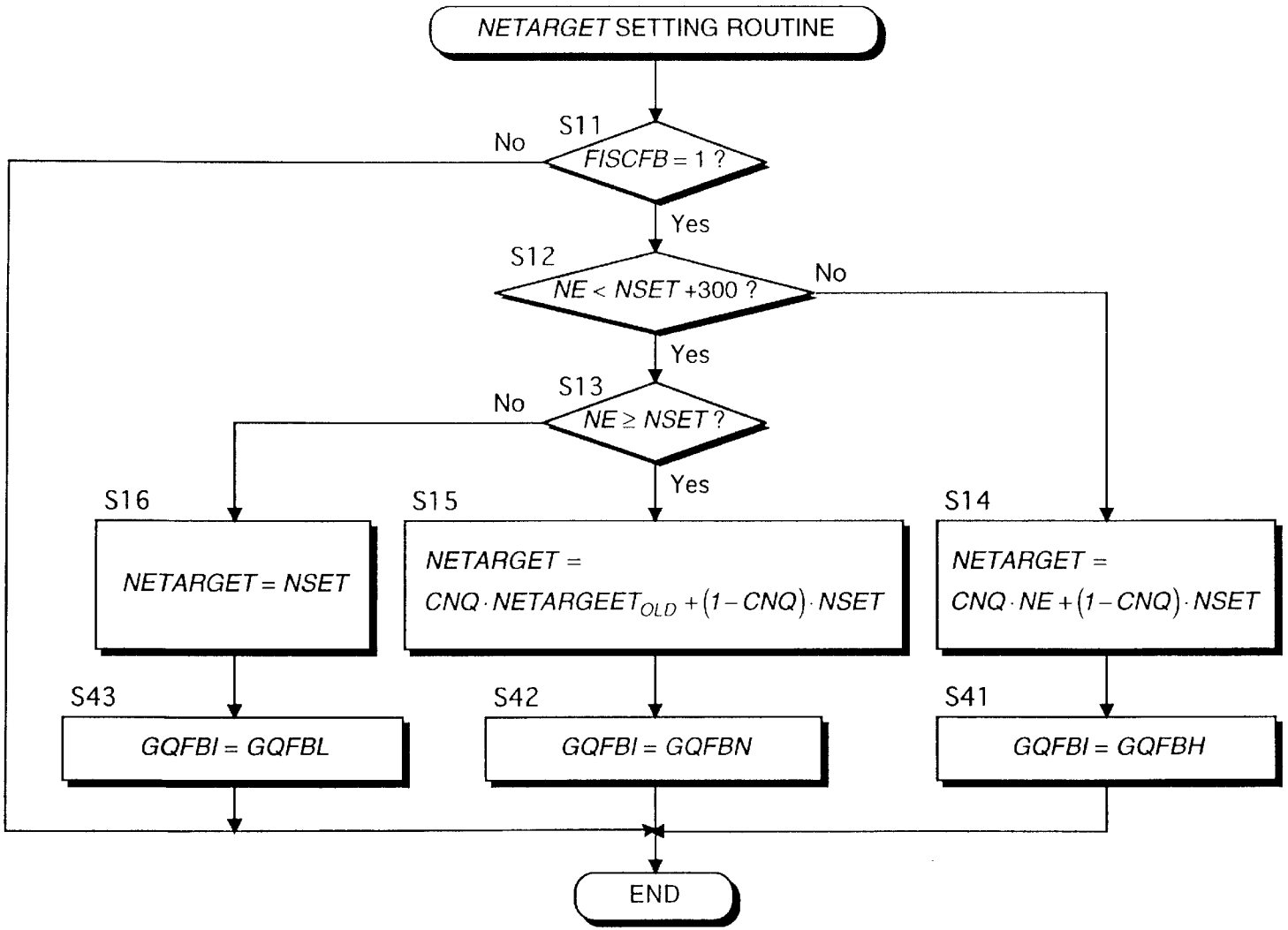
FIG. 11 is similar to FIG. 3, but showing a second embodiment of this invention.

The flowchart of FIG. 11 shows a second embodiment of this invention.

Figure 12A:
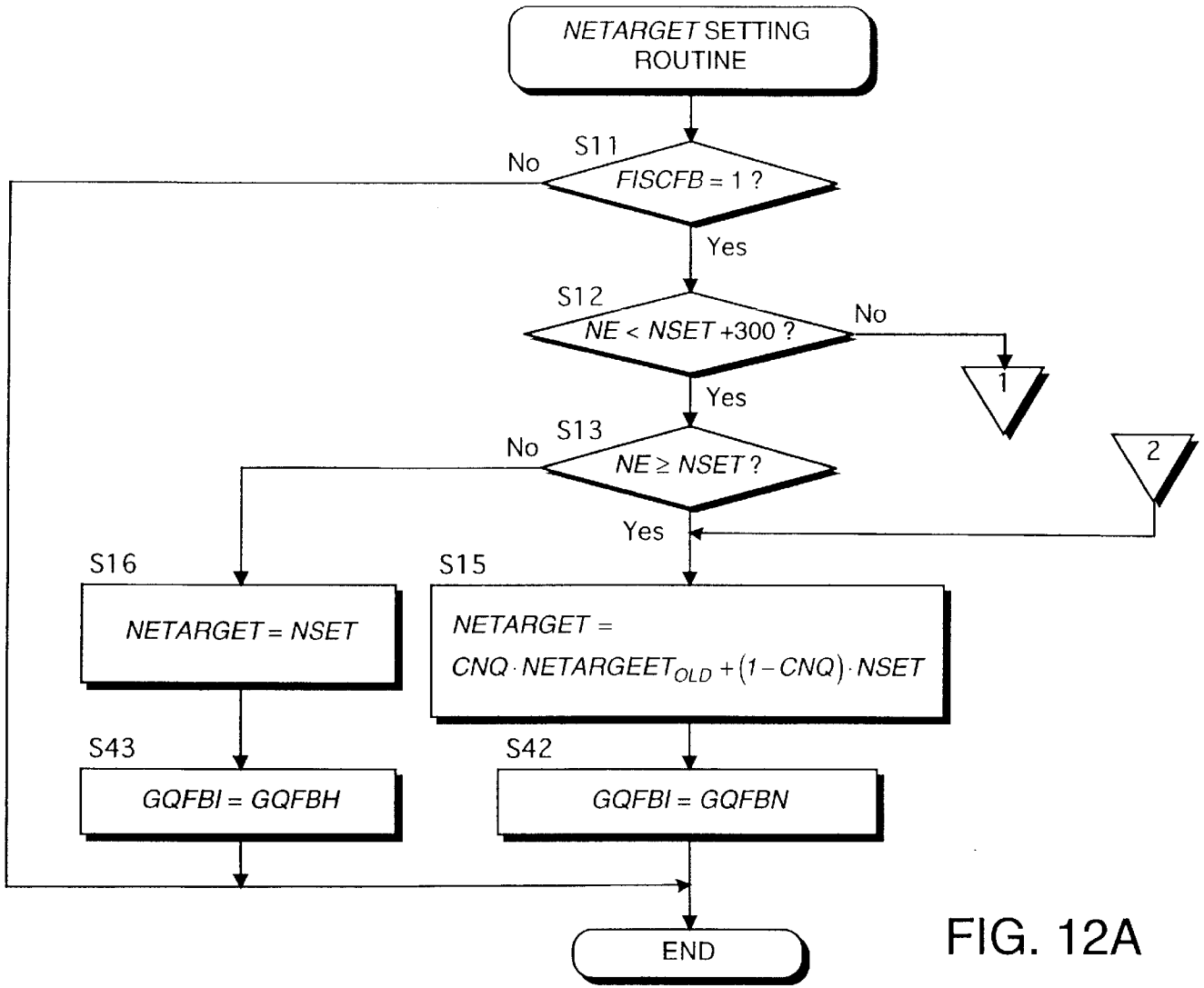
FIGS. 12A and 12B are flowcharts describing a process of calculating a second target rotation speed NETARGET and a feedback gain GQFBI according to a third embodiment of this invention.
Figure 12B:
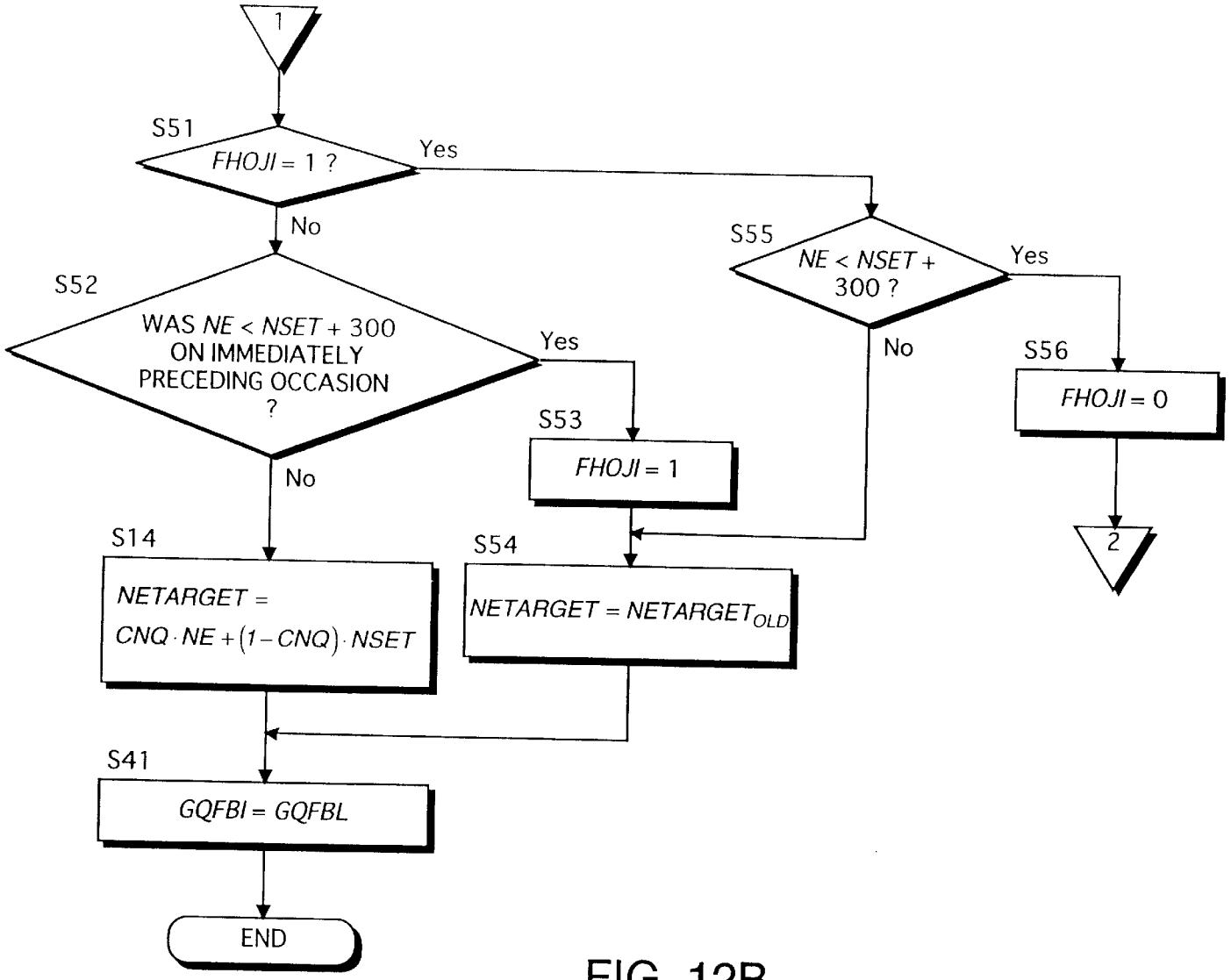

The flowcharts of FIGS. 12A, 12B show a third embodiment of this invention.

Whereas according to the first embodiment, the integral gain GQFBI in integral control using the supplementary air valve 20 was a constant value GQFBN in all of the above three rotation speed regions (i), (ii), (iii), according to the second and third embodiments, the integral gain GQFBI is changed over for each of these regions.

In other words, as shown by steps S41, S42 and S43 of the second embodiment, in the rotation speed region (i) where NSET+300≦NE, a predetermined value GQFBL less than GQFBN, in the rotation speed region (ii) where NSET≦NE<NSET+300 the aforesaid GQFBN, and in the rotation speed region (iii) where NE<NSET, a predetermined value GQFBH larger than GQFBN, are respectively set to the integral gain GQFBI.

Hence, in the region above the second rotation speed N2(=NSET+300). the integral gain GQFBI is set to a low value GQFBL, so the integral part I of the decrease of intake air flowrate in the process of converging to the first target rotation speed NSET is less than in the first embodiment. In the rotation speed region less than NSET, the integral gain GQFBI is set to GQFBH which is higher than GQFBN, so the integral part I controls the supplementary air valve flowrate so that it increases more than in the first embodiment. The time during which the engine rotation speed is less than the first target rotation speed NSET is therefore shortened.

According to the third embodiment, steps S51, S52, S53, S54, S55 and S56 are provided in addition to those of the second embodiment.

A characteristic feature of this embodiment is the processing performed when, after the engine rotation speed NE reaches a rotation speed region below NETARGET+300 in the step S12, the engine rotation speed NE rises above NSET+300 due to a sharp decrease of load as a result of shift-down, etc. According to this embodiment, in such a case, the value of NETARGET computed by the above equation (3) immediately prior to when the engine rotation speed NE rises above NSET+300 is held for as long as NE remains above NSET+300. Specifically, when NE≧NSET+300 in the step S12, a hold flag FHOJI is determined in the step S51 of FIG. 13. When the flag FHOJI =1, the value of NETARGET is held. The flag FHOJI is initialized to "0" on startup, therefore FHOJI=0 the first time the determination result of the step S12 exceeds NSET+300.

In this case, FHOJI≠1 in the determination of the step S51, so the routine proceeds to the step S52. At this point it is determined whether NE<NSET+300 on the immediately preceding occasion, and if so, it is determined that the rotation speed has risen due to a sharp decrease of load.

In this case, the flag FHOJI is set to "1" in the step S53, and NETARGET is computed by the following equation (8) in the step S54.

$$\text{NETARGET}=\text{NETARGET}_{OLD} \tag{8}$$

Herein, $\text{NETARGET}_{OLD}$ is the value of NETARGET computed by the step S15 of FIG. 12A immediately before NE reaches NSET+300. As in the case of the aforesaid second embodiment, the integral gain GQFBI is then set to a predetermined value GQFBL less than GQFBN in the step S41.

Due to the setting of the flag FHOJI to "1", the next time the routine is executed, the process proceeds to the step S55 from the step S51, and if NE is still less than NSET+300 in the step S55, the processing of the steps S54 and S41 is performed. Therefore, provided that NE remains above NSET+300 NETARGET is held at a constant value.

When NE<NSET+300 in the step S55, the flag FHOJI is reset to "0" in the step S56, and the processing of the steps S15, S42 of FIG. 12A is performed.

Figures 13A, 13B:
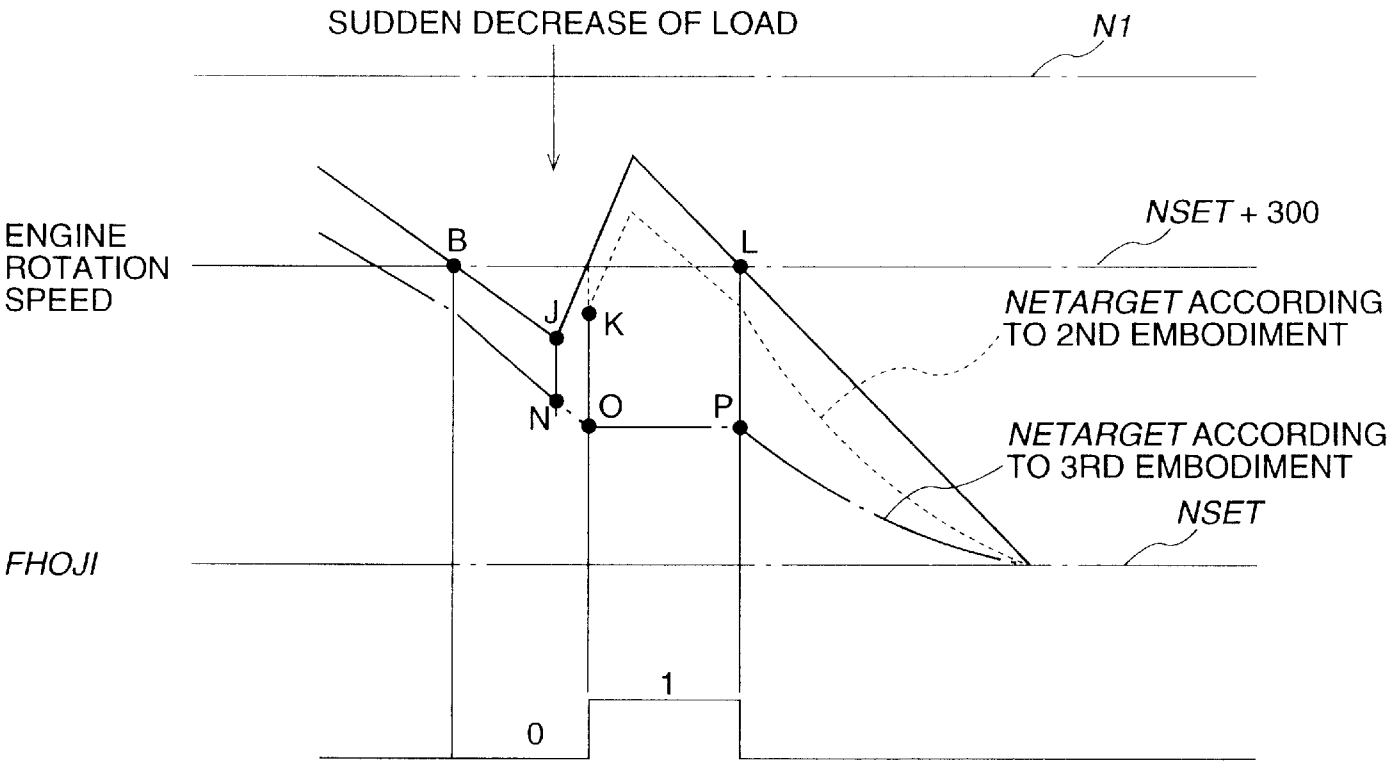
FIGS. 13A and 13B are timing charts showing changes of engine rotation speed and a flag FHOJI according to the third embodiment.

FIG. 13A, 13B show the control results of the third and second embodiments. Herein, after the engine rotation speed NE decreases to less than NSET+300 it increases from a point J due to a sharp decrease of load. In this case, at a point K where the rotation speed NE returns to NSET+300, the second target rotation speed NETARGET shown by the single dotted line in the figure approaches the first target rotation speed NSET. During this interval, the difference ΔN between NETARGET and NE increases. When NE exceeds NSET+300 at the point K. the second target rotation speed NETARGET is held at its value at a point O until NE is again less than NSET+300 at a point L.

The second target rotation speed NETARGET of the second embodiment is shown by a broken line. According to the third embodiment, ΔN (=NETARGET−NE) does not become as small as in the second embodiment. Therefore, the integral part I of the intake air volume feedback amount increases negatively more than in the first embodiment of FIG. 9, as shown in FIG. 14B.

Figure 14A:
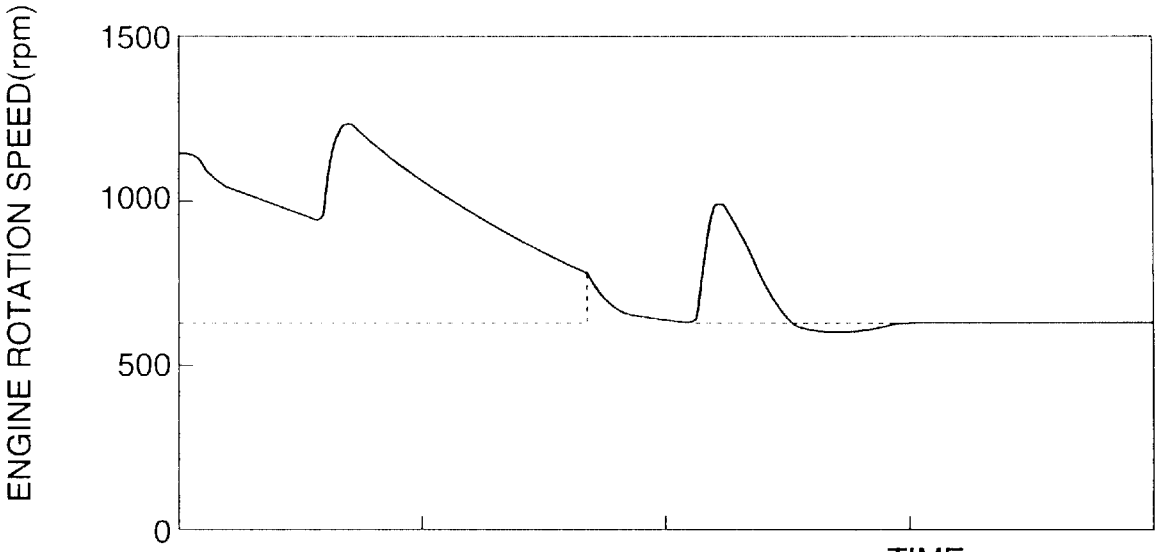
FIGS. 14A and 14B are timing charts showing changes of engine rotation speed and intake air volume feedback correction amount according to the third embodiment.
Figure 14B:
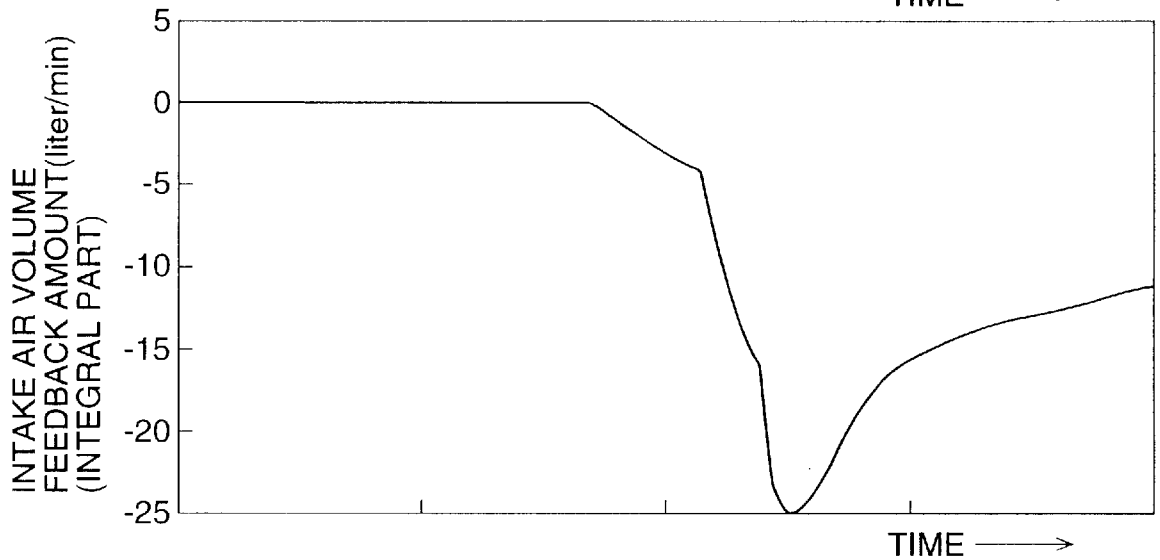

However, even in this third embodiment, ΔN is still much less than in the prior art, and drops of engine rotation speed immediately after a temporary sharp rise of engine rotation speed NE due to a sharp decrease of load in the region to which equation (3) is applied, are still suppressed as shown in FIG. 14A.

Figure 15:
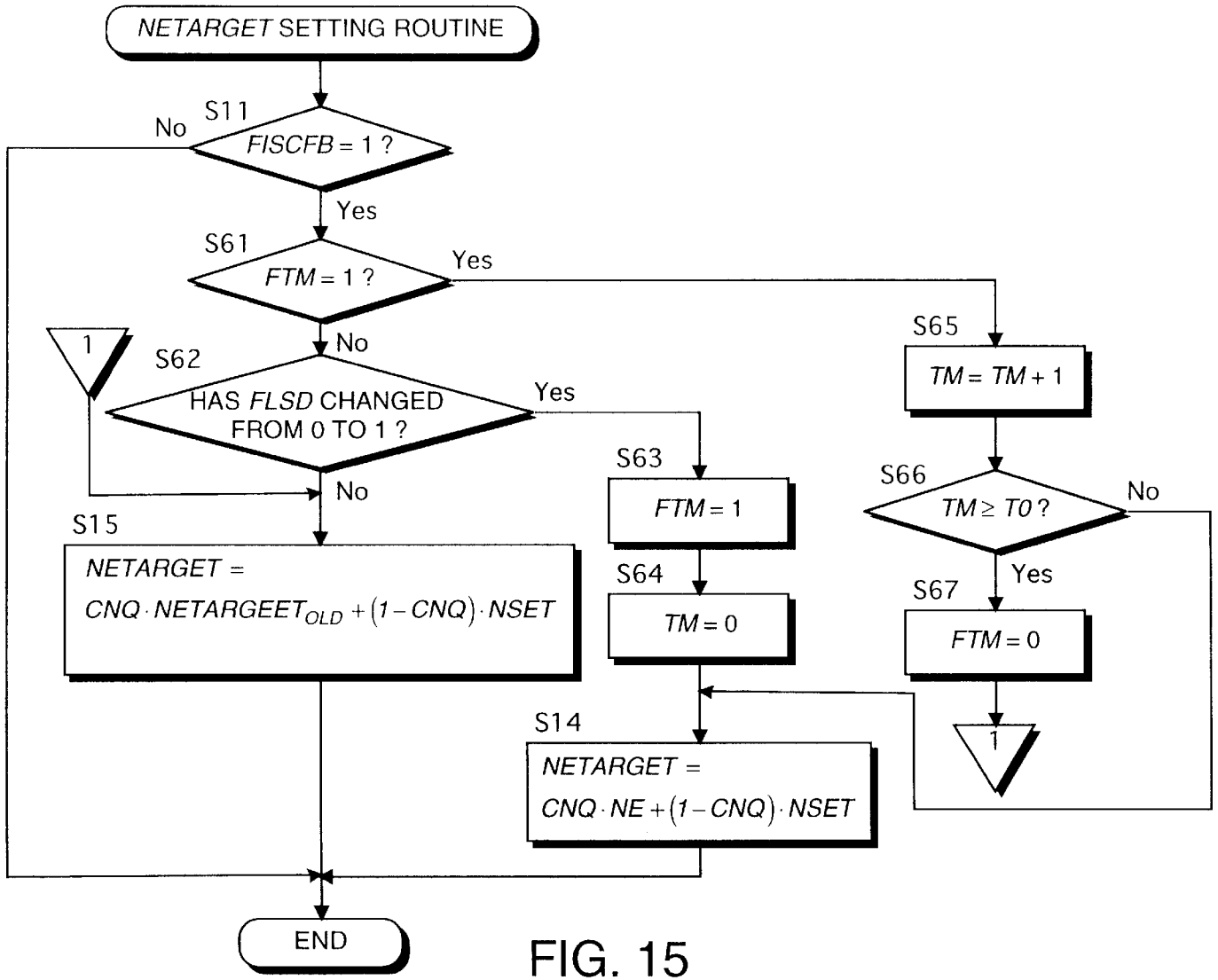
FIG. 15 is a flowchart describing a process for calculating the second target rotation speed NETARGET according to a fourth embodiment of this invention.

FIG. 15 shows a fourth embodiment of this invention.

This flowchart corresponds to the process of FIG. 3 of the first embodiment.

Figure 16:
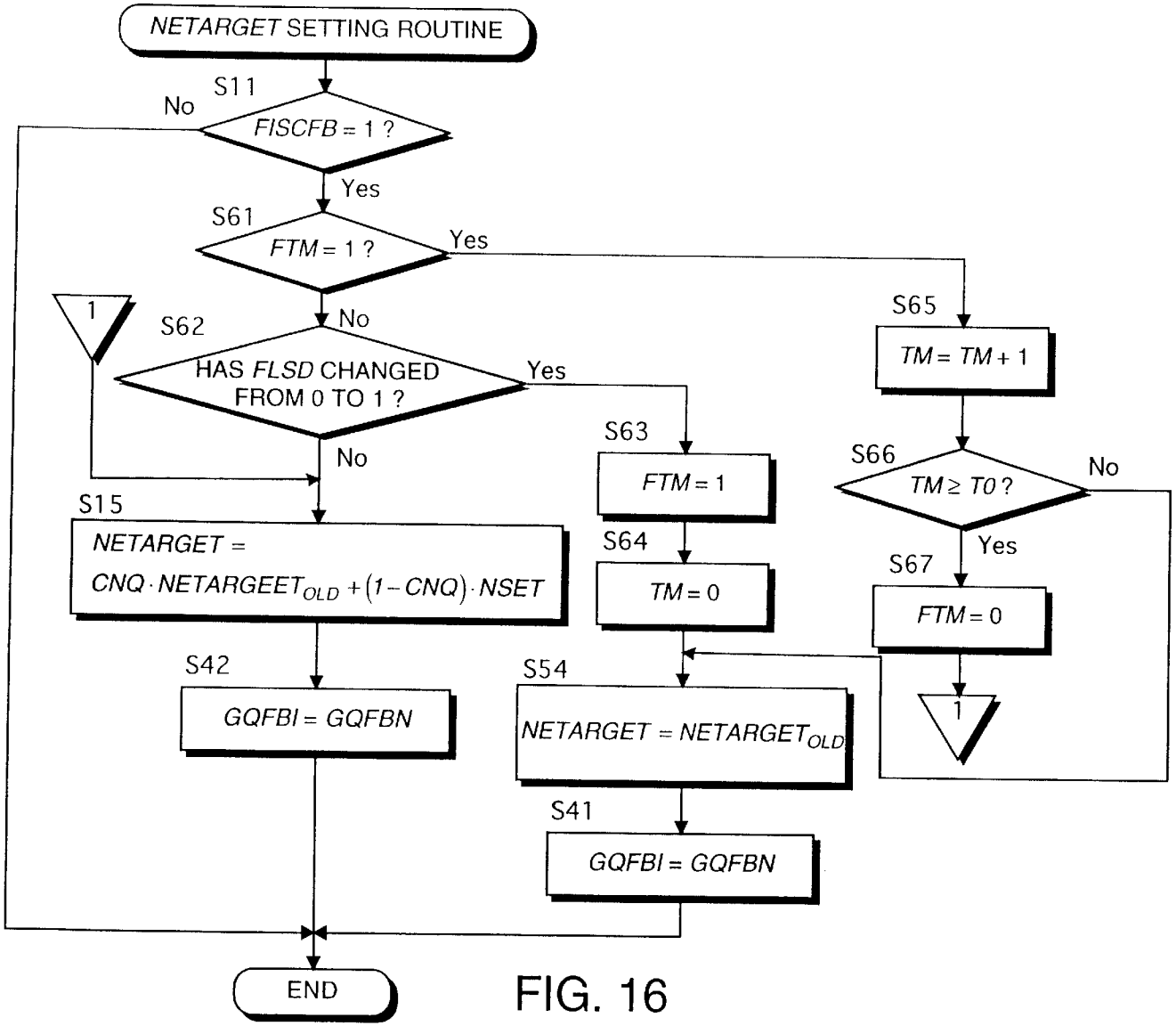
FIG. 16 is a flowchart describing a process for calculating the second target rotation speed NETARGET and the feedback gain GQFBI according to a fifth embodiment of this invention.

FIG. 16 shows a fifth embodiment of this invention. This flowchart corresponds to the process of FIGS. 12A, 12B of the third embodiment.

In the fourth and fifth embodiments, instead of determining the conditions for calculating the second target rotation speed NETARGET according to the engine rotation speed NE, this is done by a time flag FTM and sharp load decrease flag FLSD. In the fourth embodiment, when feedback control conditions hold in the step S11 of FIG. 15, the time flag FTM is determined in a step S61. As the initial value of the time flag FTM is 0, when FISCFB=1 for the first time in the step S11. FTM=0. In this case, the sharp load decrease flag FLSD is determined in a step S62.

The sharp load decrease flag FLSD is set to "1" when the variation rate of vehicle speed/NE does not lie within for example ±10%, and is reset to "0" when it does lie within a predetermined range, by a separate 10 ms job, not shown. In other words, it is set to "1" when the load is sharply decreasing.

The process of the step S62 determines whether or not the sharp load decrease flag FLSD has changed from "0" to "1". In other cases, when the sharp load decrease flag FLSD holds the same value or has changed from 1 to 0, the determination result is NO, and the second target rotation speed NETARGETis calculated by the above equation (3) in the step S15. The initial value of NETARGET in this case is the rotation speed when feedback control starts, i.e. N1 for example.

When it is determined in the step S62 that the sharp load decrease flag FLSD has changed from "0" to "1", the time flag FTM is set to "1" in a step S63, and a timer value TM is set to 0 in a step S64. The second target rotation speed NETARGET is also computed by the above equation (2) in the step S14.

By setting the time flag FTM to "1" in the step S63, provided that feedback control conditions hold, the routine proceeds from the step S61 to the step S65 the next time the routine is executed.

At this point, the timer value TM is incremented, and after it has been incremented in a step S66, it is compared with a predetermined time TO.

This predetermined time TO is set as a guide of the time from when the engine rotation speed NE temporarily rises due to a shift-down, to when it falls back to the rotation speed at which shift-down started to occur.

In practice, the predetermined time TO is found by experiment.

Provided that the comparison result of the step S66 is TM<TO, the second target rotation speed NETARGET is calculated by equation (2) in the step S14.When the comparison result of the step S66 is TM≦TO, the time flag FTM is reset to "0" in a step S67, and NETARGET is computed by equation (3) in the step S15. The initial value of NETARGET in this case is the value of NETARGET computed by equation (2) immediately prior to when the timer TM reaches TO.

In the fifth embodiment, the step S14 of FIG. 15 is replaced by the step S54, and the steps S41, S42 are added.

During the predetermined time TO after the sharp load decrease flag FLSD has changed from "0" to "1", whereas the fourth embodiment computes NETARGET using equation (2) the fifth embodiment holds NETARGET at the value computed in the step S15 immediately prior to change-over of the sharp load decrease flag FLSD in the step S54. The steps S41 and S42 are the same as in the second embodiment.

Figures 17A, 17B:
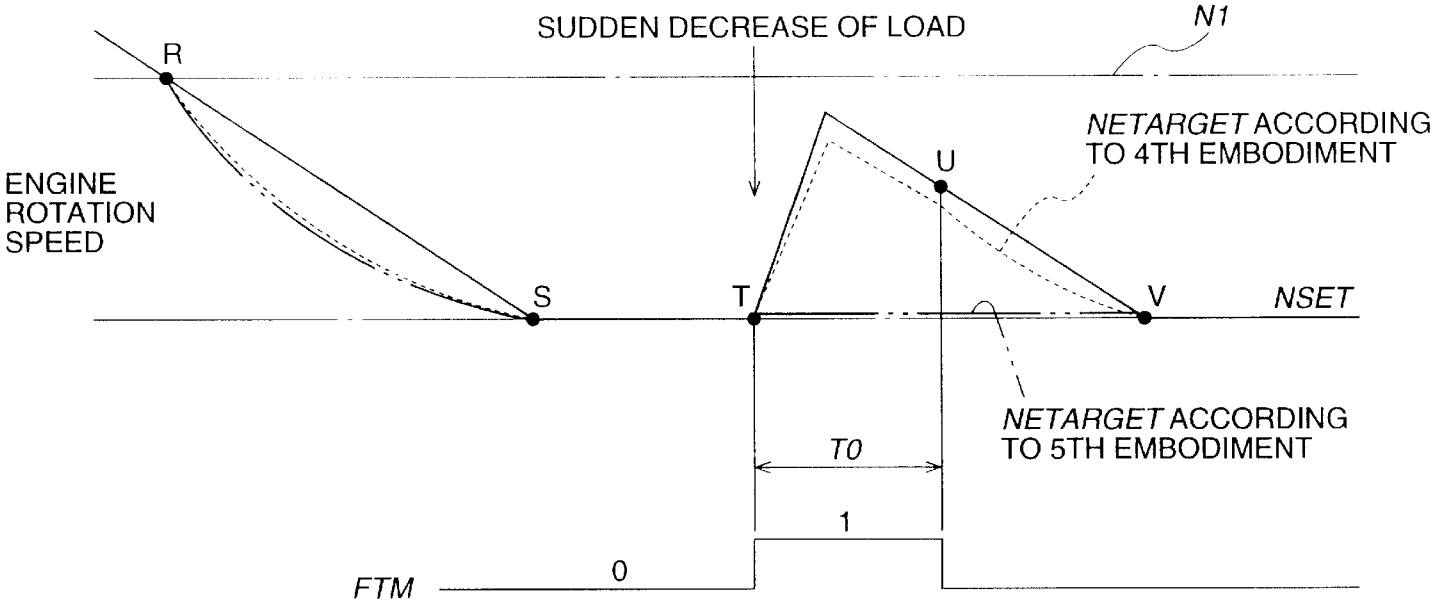
FIGS. 17A and 17B are timing charts showing changes of engine rotation speed and a time flag FTM according to the fourth and fifth embodiments.

Examples of the control of the fourth and fifth embodiment are shown in FIGS. 17A and 17B.

During the transition from coasting or deceleration to the idle state. i.e. in an interval R-S, the second target rotation speed NETARGET follows the first target rotation speed NSET with the feedback start rotation speed N1 as initial value, as shown by the broken line for the fourth embodiment and the double-dotted line for the fifth embodiment in FIG. 17A.

After the engine rotation speed NE has settled at the first target rotation speed NSET and the load decreases sharply due to a shift-down, the engine rotation speed NE temporarily rises sharply.

According to the fourth embodiment, in an interval T-U, a value obtained from the aforesaid equation (2) is set as the second target rotation speed NETARGET, and from the point U, NETARGET is made to follow NSET with a first order delay.

On the other hand, according to the fifth embodiment, NETARGET coincides with NSET in an interval T-V.

Figures 18A, 18B:
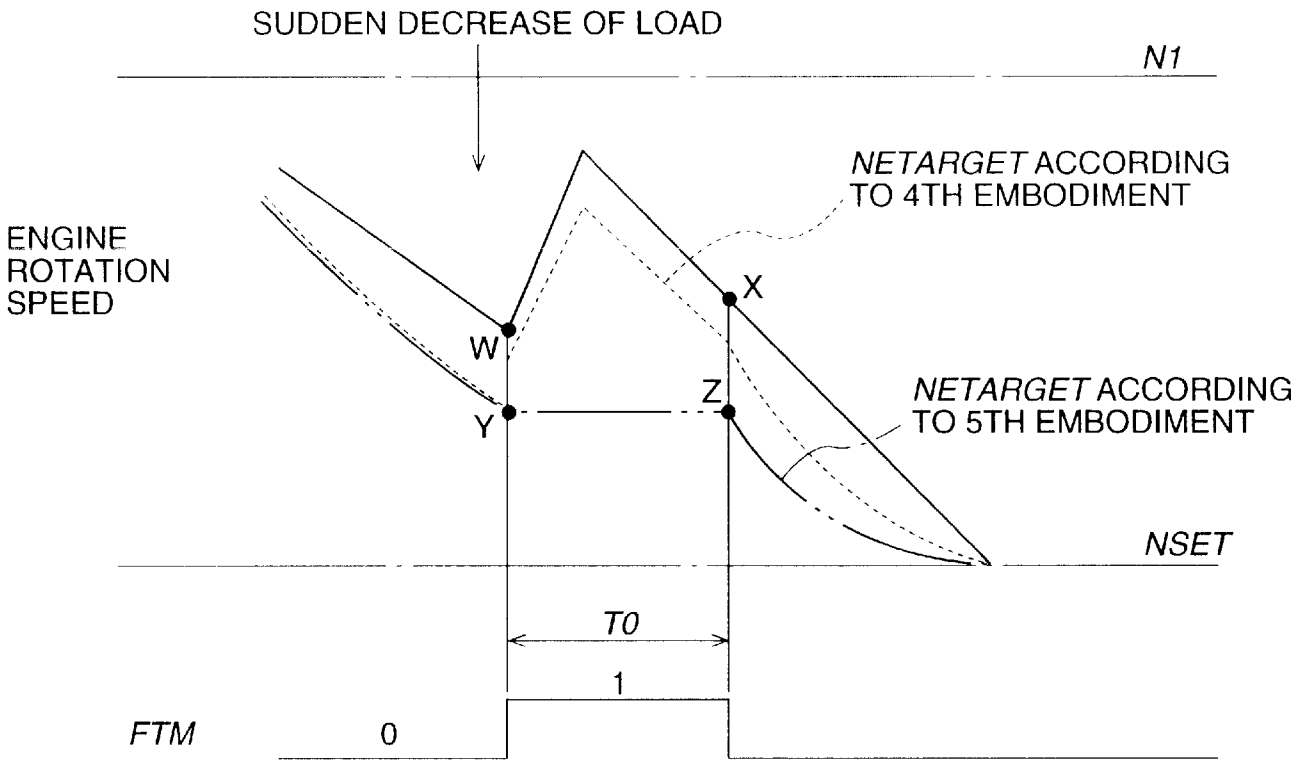
FIGS. 18A and 18B are similar to FIGS. 17A and 17B, but showing changes of engine rotation speed and a time flag FTM due to a shift-down during acceleration according to the fourth and fifth embodiments.

FIGS. 18A and 18B show a case where, while the engine rotation speed NE is converging to NSET, the engine rotation speed NE temporarily rises sharply due to a sharp decrease of load as a result of shift-down.

According to the fourth embodiment, in an interval W-X, NETARGET takes a value obtained from the aforesaid equation (2).

After the point X, NETARGET follows NSET with a first order delay.

On the other hand according to the fifth embodiment, NETARGET in the interval W-X is held at its value at a point Y, and follows NSET with a first order delay after a point Z.

Figure 19A:
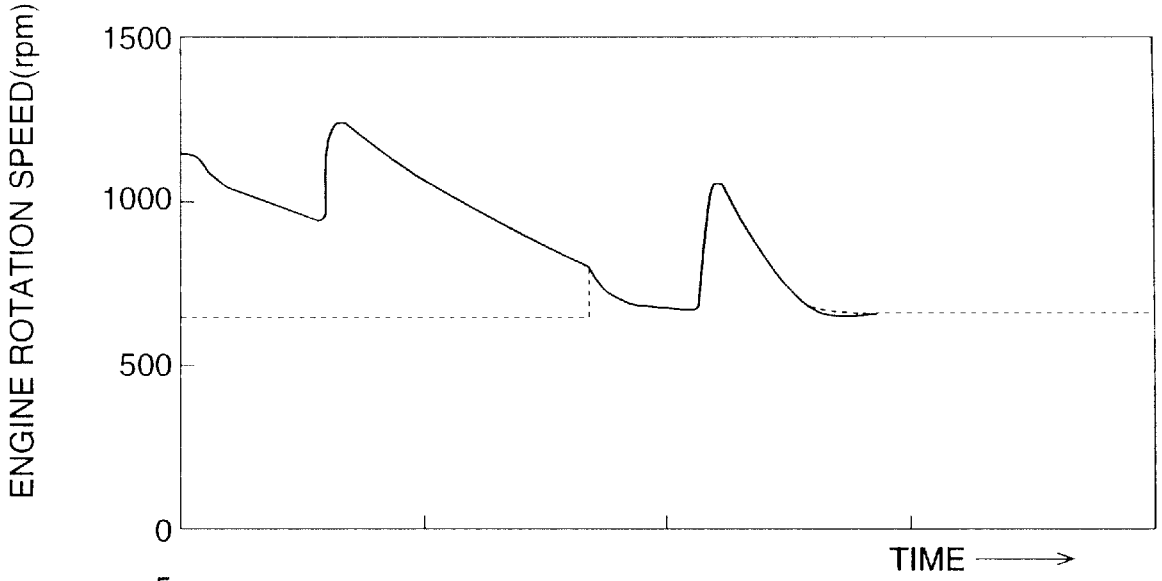
FIGS. 19A and 19B are timing charts describing changes of engine rotation speed and intake air volume feedback correction amount according to the fourth embodiment.
Figure 19B:
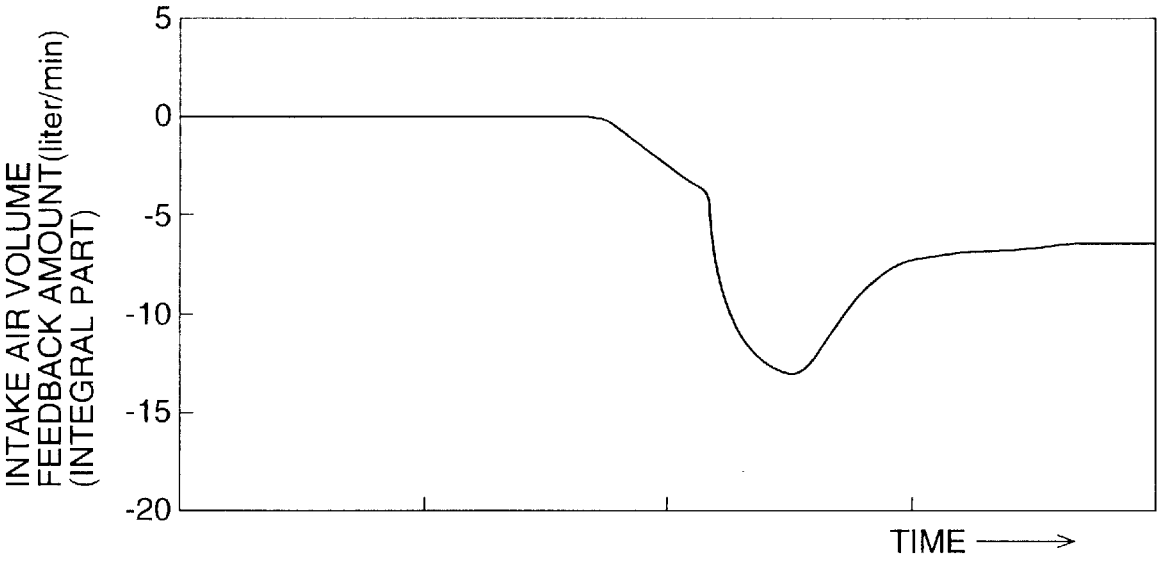

The results of an experiment performed using the fourth embodiment under the same conditions as those of FIG. 9 are shown in FIGS. 19A and 19B. According to the fourth embodiment, the same results as those of the first embodiment were obtained.

Figure 20A:
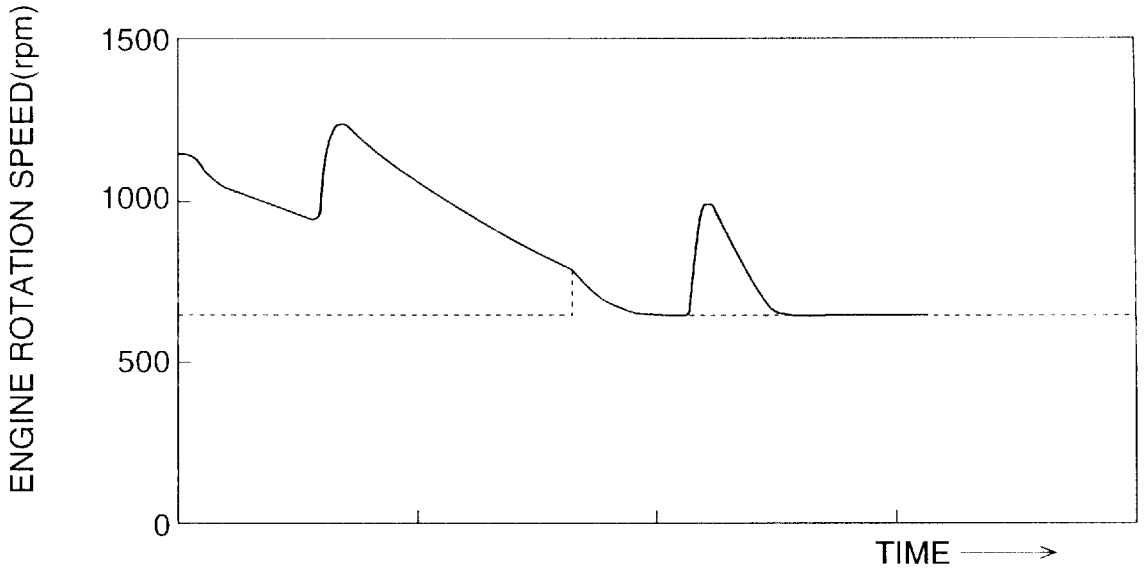
FIGS. 20A and 20B are timing charts describing changes of engine rotation speed and intake air volume feedback correction amount according to the fifth embodiment.
Figure 20B:
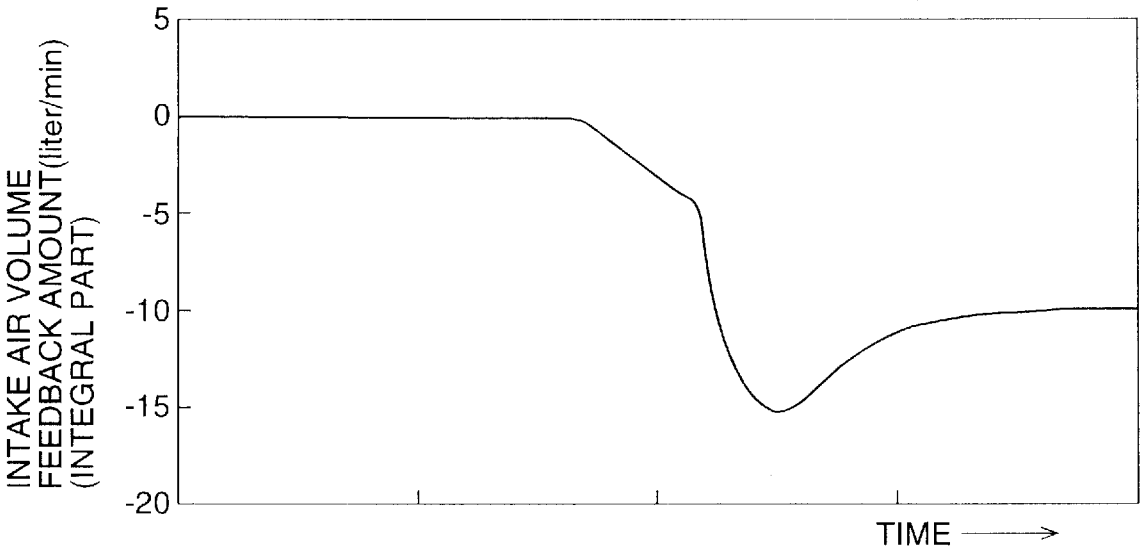
Figure 21A:
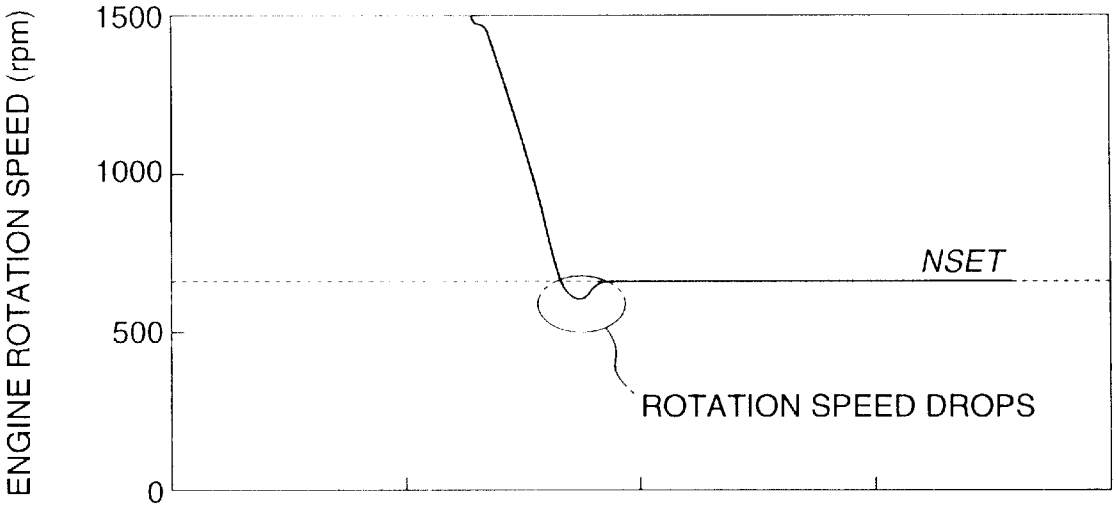
FIG. 21A PRIOR ART
FIGS. 21A and 21B are timing charts describing changes of engine rotation speed and intake air volume feedback correction amount under the control of the prior art controller.
Figure 21B:
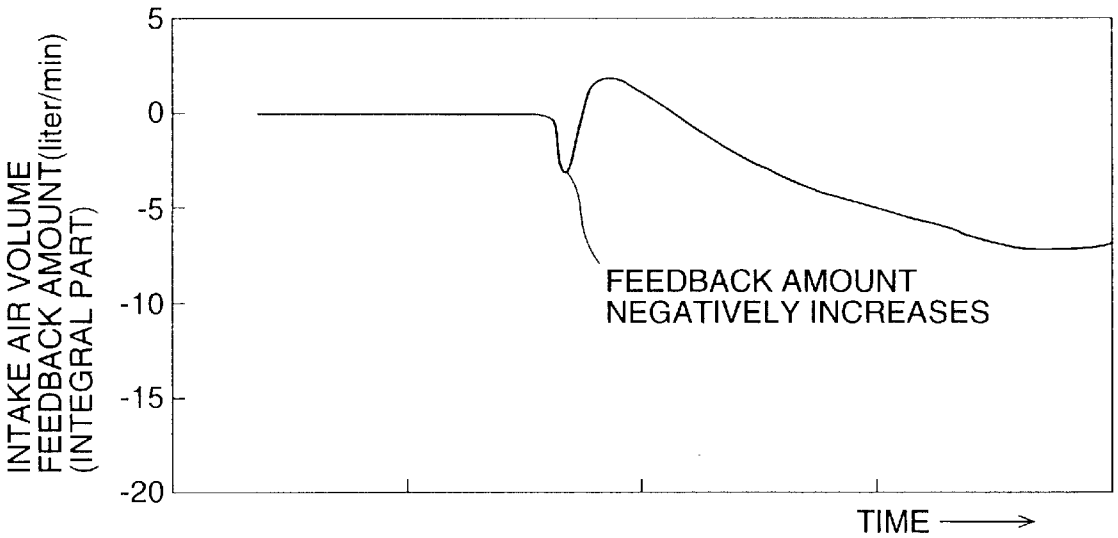
FIG. 21B PRIOR ART
Figure 22A:
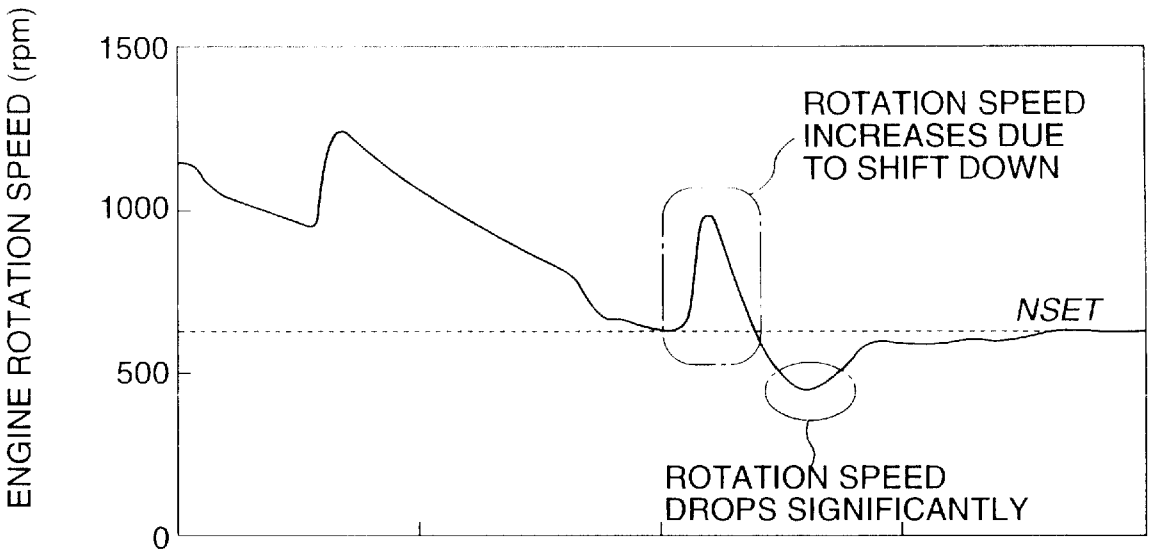
FIG. 22A PRIOR ART
FIGS. 22A and 22B are timing charts describing changes of engine rotation speed and intake air volume feedback correction amount when there is a sudden decrease in load due to a shift-down, under the control of the prior art controller.
Figure 22B:
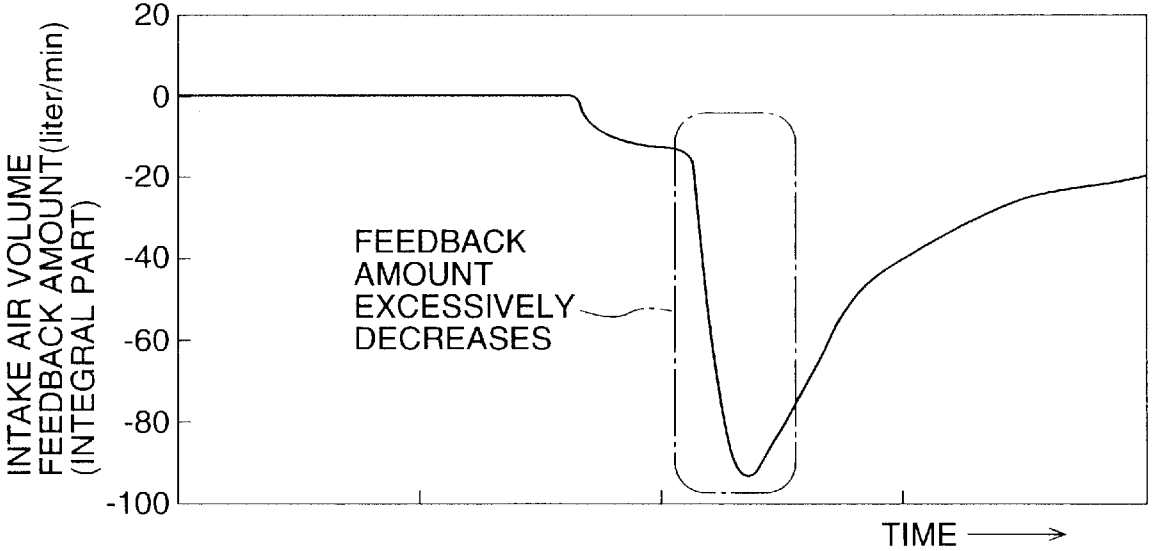
FIG. 22B PRIOR ART

The results of an experiment performed using the fifth embodiment under the same conditions as those of FIG. 14 are shown in FIGS. 20A and 20B. According to the fourth embodiment, the same results as those of the third embodiment were obtained.

The aforesaid second—fifth embodiments are all examples where the feedback of idle rotation speed is subjected to integral control via the increase/decrease of the intake air volume, but integral control may also be used in other cases. For example, integral control may be used in feedback control of idle rotation speed via the ignition timing, or feedback control of idle rotation speed via the air-fuel ratio.

This invention is however not limited to integral control, and may also be applied to feedback control of idle rotation speed by proportional control or differential control. This is because even when proportional control is used, the feedback amount increases if the difference between the target engine rotation speed and the engine rotation speed is large when feedback control starts, and this leads to hunting.

As represented by the first embodiment in which feedback control is performed via both air amount control and ignition timing control, this invention may be applied to cases where the same target rotation speed NETARGET is feedback-controlled by a plurality of mechanisms.

When this plurality of control mechanisms have different responses, the target rotation speed NETARGET must be set to fit the mechanism with the poorest response. For example, when feedback control is performed using a combination of air volume control, ignition timing control or air-fuel ratio control, air-fuel ratio control has the slowest response. In other words, the time from when the air volume is shifted towards higher torque to when the torque actually increases, is longer than the time from when the ignition timing is shifted towards higher torque to when the torque actually increases. The target rotation speed NETARGET must therefore be calculated with a second order delay or first order delay taking account of the response from an air volume change to a rotation speed change.

According to the aforesaid embodiments, when there is a transition from coasting or deceleration to the idle state, the second target rotation speed NETARGET is calculated so as to approach the first target rotation speed NSET from the engine rotation speed when feedback control starts. However, even if the calculation of the second target rotation speed NETARGET starts from a predetermined first target rotation speed other than the engine rotation speed when feedback control starts, the engine rotation speed can still be made to converge to the first target rotation speed NSET without any large drops after reaching the first target rotation speed NSET.

According to the aforesaid embodiments, the weighted average coefficient CNQ was set according to factors affecting drops of engine speed, i.e. engine inertial moment, inertial moment of the drive system, collector capacity, cooling water temperature, battery voltage, presence or absence of a link between the engine and drive system, and accessory loads.

A common value may however also be used for the weighted average coefficient CNQ regardless of these factors.

According to the aforesaid embodiments, the second target rotation speed NETARGET is made to approach the first target rotation speed NSET with a first order delay, but the same effect may be obtained by making the second target rotation speed NETARGET approach the first target rotation speed NSET with a second order delay having characteristics that do not cause a drop in rotation speed.

According to the aforesaid embodiments, the second target rotation speed NETARGET is made to follow NSET with a first order delay or second order delay, but the calculation of NETARGET is not limited thereto, For example, NETARGET may also be made to approach NSET at a predetermined linear decrease rate, or to approach NSET gradually in steps, from the feedback control start rotation speed.

According to the second and fifth embodiments, as feedback control is an integral control, the integral gain is changed over, however when for example proportional control is applied to feedback control, a proportional gain may be changed over. Herein, integral gain and proportional gain are collectively referred to as feedback gain.

According to the fourth and fifth embodiments, sharp decreases of load are estimated based on the rate of variation of vehicle speed/NE, but these sharp load decreases may also be directly detected. For example, they may be detected from a shift-down of gear from second to first gear of the automatic transmission, or when a load relay changes from ON to OFF, as in the aforesaid prior art.

The embodiments of this invention in which an exclusive property or privilege is claimed are defined as follows:

1. A controller for feedback-controlling a rotation speed during idle running of a vehicle engine, comprising:

means for detecting a vehicle running condition, means for setting a first target rotation speed during idle running of said engine according to said running conditions, means for setting a second target rotation speed which progressively approaches said first target rotation speed from a predetermined first rotation speed, means for detecting an engine rotation speed, means for varying said engine rotation speed, and means for setting a second target rotation speed within a range between said engine rotation speed detected by said detecting means and said first target rotation speed such that said second target rotation speed progressively approaches said first target rotation speed from a predetermined first rotation speed, means for feedback-controlling said engine rotation speed via said varying means so that said engine rotation speed converges to said second target rotation speed.

2. An idle rotation speed controller as defined in claim 1, wherein said first rotation speed is set to the engine rotation speed when said feedback control starts.

3. An idle rotation speed controller as defined in claim 1, wherein said feedback control means comprises means for performing integral control.

4. An idle rotation speed controller as defined in claim 1, wherein said second target rotation speed setting means comprises means for setting said second target rotation speed according to factors which affect the drop of said engine rotation speed to an idle rotation speed.

5. An idle rotation speed controller as defined in claim 1, wherein said second target rotation speed setting means comprises means for setting as said second target rotation speed, a value which follows said first target rotation speed by a delay equation with a predetermined time constant using said first rotation speed as an initial value, and said varying means comprises means for varying an intake air volume of said engine.

6. An idle rotation speed controller as defined in claim 5, wherein said second target rotation speed setting means comprises means which sets said time constant to be larger the larger the inertial moment of said engine.

7. An idle rotation speed controller as defined in claim 5, wherein said second target rotation speed setting means comprises means which sets said time constant to be larger the larger the inertial moment of a drive system of the vehicle when said engine is connected to said drive system.

8. An idle rotation speed controller as defined in claim 5, wherein said second target rotation speed setting means comprises means which sets said time constant to be larger the larger a collector capacity of said engine.

9. An idle rotation speed controller as defined in claim 5, wherein said second target rotation speed setting means comprises means which sets said time constant based on said vehicle running condition.

10. An idle rotation speed controller as defined in claim 9, wherein said vehicle running condition detecting means comprises means for detecting a cooling water temperature of said engine, and said second target rotation speed setting means comprises means which sets said time constant to be smaller the lower said cooling water temperature.

11. An idle rotation speed controller as defined in claim 9, wherein said vehicle running condition detecting means comprises means for detecting a voltage of a battery charged by the running of said engine, and said second target rotation speed setting means comprises means which sets said time constant to be smaller the lower said battery voltage.

12. An idle rotation speed controller as defined in claim 9, wherein said vehicle running condition detecting means comprises means for detecting a deceleration of said vehicle when said engine and a drive system of said vehicle are connected, and said second target rotation speed setting means comprises means which sets said time constant to be smaller the larger said deceleration.

13. An idle rotation speed controller as defined in claim 9, wherein said vehicle running condition detecting means comprises means for detecting a deceleration of said engine when said engine and a drive system of said vehicle are connected, and said second target rotation speed setting means comprises means which sets said time constant to be smaller the larger said deceleration.

14. An idle rotation speed controller as defined in claim 9, wherein said vehicle running condition detecting means comprises means for detecting an accessory load of said engine, and said second target rotation speed setting means comprises means which sets said time constant to be smaller the larger said accessory load.

15. An idle rotation speed controller as defined in claim 9, wherein said second target rotation speed setting means comprises means for setting a plurality of time constants based on a plurality of conditions, and means for applying a time constant equal to or greater than a maximum value of said time constants to said delay equation.

16. An idle rotation speed controller as defined in claim 1, wherein said vehicle running condition detecting means comprises means for detecting a rotation speed of said engine, and said second target rotation speed setting means comprises means for applying a rotation speed lower than the present engine rotation speed to said second target rotation speed in a predetermined speed region above a second rotation speed which is higher than said first rotation speed.

17. An idle rotation speed controller as defined in claim 16, wherein said feedback control means comprises means for applying a value smaller than a feedback gain used in a rotation speed region below said second rotation speed, to a feedback gain applied to feedback control in a region where said engine rotation speed is higher than said second rotation speed.

18. An idle rotation speed controller as defined in claim 16, wherein said applying means comprises means for storing said second target rotation speed immediately prior to when said engine rotation speed rises above said second rotation speed, and means for applying a stored value stored by said storing means to said second target rotation speed from when said engine rotation speed rises above said second rotation speed to when said engine rotation speed falls below said second rotation speed.

19. An idle rotation speed controller as defined in claim 1, wherein said vehicle running condition detecting means comprises means for detecting a sharp decrease of engine load and means for detecting an engine rotation speed, and said second target rotation speed setting means comprises means for measuring an elapsed time from when said engine load sharply decreases and means for using a rotation speed lower than an engine rotation speed detected by said engine rotation speed detecting means, as said second target rotation speed until said elapsed time reaches a predetermined time.

20. An idle rotation speed controller as defined in claim 19, wherein said feedback control means comprises means for applying a value smaller than a feedback gain prior to a sharp decrease of said engine load, to a feedback gain applied to feedback control, from when said engine load decreases sharply to when said elapsed time reaches said predetermined time.

21. An idle rotation speed controller as defined in claim 19, wherein said applying means comprises means for storing said second target rotation speed immediately prior to a sharp decrease of said engine load, and means for applying a stored value stored by said storing means to said second target rotation speed until said elapsed time reaches said predetermined time.

22. An idle rotation speed controller as defined in claim 19, wherein said sharp load decrease detecting means comprises means for detecting a shift-down of an automatic transmission with which said vehicle is provided.

23. An idle rotation speed controller as defined in claim 1, wherein said vehicle running condition detecting means comprises means for detecting an engine rotation speed, and said second target rotation speed setting means comprises means for applying said first target rotation speed to said second target rotation speed when said engine rotation speed is less than said first target rotation speed.

24. An idle rotation speed controller as defined in claim 23, wherein said feedback control means comprises means for applying a value smaller than a feedback gain in a rotation speed region above said first target rotation speed, to said feedback gain applied to feedback control, in a region where said engine rotation speed is less than said first target rotation speed.

* * * * *